US008147353B2

(12) United States Patent
Gilbert et al.

(10) Patent No.: US 8,147,353 B2
(45) **Date of Patent: *Apr. 3, 2012**

(54) IRON-TYPE GOLF CLUB

(75) Inventors: Peter J. Gilbert, Carlsbad, CA (US); Charles E. Golden, Encinitas, CA (US); Michael Scott Burnett, Plano, TX (US)

(73) Assignee: Acushnet Company, Fairhaven, MA (US)

( * ) Notice: Subject to any disclaimer, the term of this patent is extended or adjusted under 35 U.S.C. 154(b) by 78 days.

This patent is subject to a terminal disclaimer.

(21) Appl. No.: 12/099,244

(22) Filed: Apr. 8, 2008

(65) Prior Publication Data

US 2009/0075751 A1 Mar. 19, 2009

Related U.S. Application Data

(63) Continuation-in-part of application No. 11/854,689, filed on Sep. 13, 2007, now Pat. No. 8,062,150.

(51) Int. Cl.
*A63B 53/04* (2006.01)

(52) U.S. Cl. ..... 473/345; 473/350

(58) Field of Classification Search ..... 473/324–350
See application file for complete search history.

(56) References Cited

U.S. PATENT DOCUMENTS

| | | | | |
|---|---|---|---|---|
| 4,645,207 | A | | 2/1987 | Teramoto et al. |
| 4,754,969 | A | | 7/1988 | Kobayashi |
| 5,048,835 | A | | 9/1991 | Gorman |
| 5,282,625 | A | | 2/1994 | Schmidt et al. |
| 5,409,229 | A | | 4/1995 | Schmidt et al. |
| 5,472,203 | A | | 12/1995 | Schmidt et al. |
| 5,492,327 | A | | 2/1996 | Biafore, Jr. |
| 5,605,511 | A | | 2/1997 | Schmidt et al. |
| D389,540 | S | | 1/1998 | Mendenhall |
| 5,704,849 | A | | 1/1998 | Schmidt et al. |
| 5,749,795 | A | | 5/1998 | Schmidt et al. |
| 5,830,084 | A | | 11/1998 | Kosmatka |
| 5,833,551 | A | * | 11/1998 | Vincent et al. ..... 473/350 |
| D404,453 | S | | 1/1999 | Wozny et al. |
| D404,780 | S | | 1/1999 | Long |
| 5,971,868 | A | | 10/1999 | Kosmatka |
| 6,030,293 | A | * | 2/2000 | Takeda ..... 473/334 |
| 6,030,295 | A | * | 2/2000 | Takeda ..... 473/345 |
| 6,042,486 | A | | 3/2000 | Gallagher |
| 6,080,069 | A | | 6/2000 | Long |
| D429,511 | S | | 8/2000 | Adams et al. |
| D438,584 | S | | 3/2001 | Adams et al. |
| D438,925 | S | | 3/2001 | Adams et al. |
| D438,926 | S | | 3/2001 | Adams et al. |
| 6,210,290 | B1 | | 4/2001 | Erickson et al. |
| D453,949 | S | | 2/2002 | Helmstetter et al. |
| 6,379,263 | B2 | | 4/2002 | Erickson et al. |
| 6,554,722 | B2 | | 4/2003 | Erickson et al. |
| D476,708 | S | | 7/2003 | Wahl et al. |
| 6,595,870 | B2 | | 7/2003 | Stites et al. |
| D489,106 | S | | 4/2004 | Wahl et al. |

(Continued)

FOREIGN PATENT DOCUMENTS

JP 2001314535 A * 11/2001

(Continued)

*Primary Examiner* — Alvin Hunter
(74) *Attorney, Agent, or Firm* — Michael J. Mancuso

(57) ABSTRACT

A a golf club including a club head having a club head main body, a supporting member and a muscle back shell. The muscle back shell is coupled to the club head main body and the supporting member.

20 Claims, 22 Drawing Sheets

U.S. PATENT DOCUMENTS

| | | | | |
|---|---|---|---|---|
| D500,350 | S | 12/2004 | Schweigert et al. | |
| D500,351 | S | 12/2004 | Schweigert et al. | |
| 6,832,962 | B2 | 12/2004 | Stites et al. | |
| D501,035 | S | 1/2005 | Wahl et al. | |
| D505,466 | S | 5/2005 | Lang et al. | |
| 6,923,732 | B2 | 8/2005 | Stites et al. | |
| 6,932,717 | B2 | 8/2005 | Hou et al. | |
| D510,115 | S | 9/2005 | Lang et al. | |
| D517,625 | S | 3/2006 | Sanchez et al. | |
| D518,539 | S | 4/2006 | Cleveland et al. | |
| 7,112,148 | B2 | 9/2006 | Deshmukh | |
| D530,760 | S | 10/2006 | Schweigert et al. | |
| 7,126,339 | B2 | 10/2006 | Nagai et al. | |
| D532,848 | S | 11/2006 | Cleveland et al. | |
| 7,186,187 | B2 | 3/2007 | Gilbert et al. | |
| 7,186,188 | B2 | 3/2007 | Gilbert et al. | |
| 7,192,361 | B2 | 3/2007 | Gilbert et al. | |
| 7,192,362 | B2 | 3/2007 | Gilbert et al. | |
| 7,410,424 | B2 * | 8/2008 | Chen | 473/291 |
| 7,591,735 | B2 * | 9/2009 | Matsunaga et al. | 473/329 |
| 2005/0170908 | A1 | 8/2005 | Reyes et al. | |
| 2007/0129168 | A1 * | 6/2007 | Matsunaga et al. | 473/349 |

FOREIGN PATENT DOCUMENTS

| | | | |
|---|---|---|---|
| JP | 2003245386 | A * | 9/2003 |
| JP | 2007275231 | A * | 10/2007 |

* cited by examiner

Table 1

| Mode | Conventional Iron Frequency (Hz) | Embodiment A Frequency (Hz) | Embodiment B Frequency (Hz) |
|---|---|---|---|
| 1 | 3983.5 | 4998.4 | 4473.8 |
| 2 | 4887.3 | 5921.7 | 5571.6 |
| 3 | 7373.5 | 7725 | 8006.5 |
| 4 | 10195 | 10051 | 10214 |
| 5 | 10507 | 11345 | 11263 |
| 6 | 14089 | 14791 | 14664 |
| 7 | 15162 | 15455 | 15833 |
| 8 | 15813 | 17575 | 16869 |
| 9 | 17698 | 18834 | 18809 |
| 10 | 20832 | 19910 | 21753 |

FIG. 14

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

(Conventional Iron)

(Embodiment A)

(Embodiment B)

IRON-TYPE GOLF CLUB

CROSS-REFERENCE TO RELATED APPLICATIONS

This application is a continuation-in-part of U.S. patent application Ser. No. 11/854,689, filed Sep. 13, 2007, now U.S. Pat. No. 8,062,150 which is incorporated herein by reference in its entirety.

FIELD OF THE INVENTION

This invention generally relates to golf clubs, and more specifically to iron-type golf club having an enclosed lower hollow cavity behind the hitting face.

BACKGROUND OF THE INVENTION

Typical iron club heads are solid with a flat hitting face and generally either muscle back and cavity back clubs. Traditionally all irons were muscle back, which are smooth at the back with low offset, thin topline and thin sole. Cavity back irons have a hollowed out back and the club head mass is redistributed to the sole and the perimeter of the club head, which moves the center of gravity lower to the ground and rearward making the iron launch the ball higher, and increases rotational moment of inertia thereby lowering its tendency to rotate on mis-hits and enlarging the sweet spot.

Some muscle back irons have an interior hollow section, such that the club resembles a muscle back on the outside but the interior hollow section alters the club's mass characteristics. One example is U.S. Pat. No. 4,645,207 to Teramoto et al. The Teramoto patent discloses a set of iron golf clubs in which the iron club is cast by the lost wax method, and the back member is welded at the back of the face member to form a hollow section between the back and face members. As the club changes from a longer iron to a shorter iron, the hollow section is gradually decreased to zero and the sole width is gradually decreased. No support is provided to the hitting face.

Another example is U.S. Pat. No. 4,754,969 to Kobayashi. The Kobayashi patent discloses a set of golf clubs wherein each one-piece club head includes a hollow section behind the striking face. Each of the club heads is made of a stainless steel by, for example, a lost wax casting process. The material of each of the face portions of the club heads is then annealed to increase its elasticity. The striking face is thinner for long irons, but no support is provided to the hitting face.

Another example is U.S. Pat. No. 7,126,339 to Nagai et al., which discloses utility golf clubs, which generally include a hollow interior.

There remains a need in the art for an improved iron-type golf club.

SUMMARY OF THE INVENTION

The present invention is directed to iron-type golf club. The inventive iron-type golf club provides a club head that provides the aesthetics of a muscle back iron while improving club head center of gravity disposition, increasing moment of inertia and sweet spot size.

In an embodiment, a golf club head includes a club head main body, a hitting face, a muscle back shell and a supporting member. The hitting face is coupled to the club head main body. The muscle back shell is coupled to a rear portion of the club head main body. The supporting member is interposed between the club head main body and at least a portion of the muscle back shell. The club head main body is constructed from a first material and the muscle back shell is constructed from a second material and the club head has a first vibration mode frequency value of at least 4000 Hz.

In another embodiment, a golf club head includes a club head main body, a hitting face, a supporting member, and a muscle back shell. The club head main body and the hitting face are a monolithic body. The muscle back shell is coupled to the club head main body and the supporting member to define an enclosed cavity. The club head has a first vibration mode frequency value of at least 4000 Hz.

In another embodiment, a golf club head includes a club head main body, a hitting face, a supporting member and a muscle back shell. The hitting face is coupled to the club head main body. The muscle back shell is coupled to the club head main body and the supporting member to define an enclosed cavity. The club head has a first vibration mode frequency value of at least 4000 Hz, a second vibration mode frequency value of at least 5000 Hz, and a third vibration mode frequency value of at least 7400 Hz.

BRIEF DESCRIPTION OF THE DRAWINGS

In the accompanying drawings, which form a part of the specification and are to be read in conjunction therewith and in which like reference numerals are used to indicate like parts in the various views:

FIG. 14 is a table providing the frequency values of a conventional iron-type golf club and embodiments of the iron-type golf club of the present invention for the first ten vibration modes;

DETAILED DESCRIPTION OF THE PREFERRED EMBODIMENTS

Figure 2:
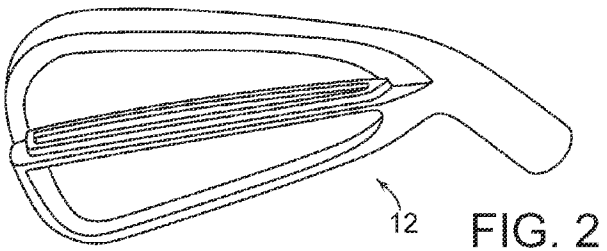
FIG. 2 is a perspective bottom view of club head main body of FIG. 1 without the muscle back shell.
Figure 3:
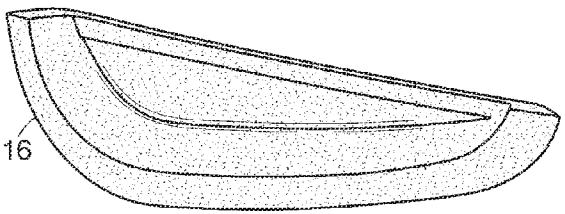
FIG. 3 is a perspective back view of muscle back shell of FIG. 1.

The present invention is directed to hollow iron-type golf clubs and can also be used with utility golf clubs. The inventive iron-type golf club provides the aesthetics of a muscle back iron while moving the center of gravity lower and further back, increasing moment of inertia, and enlarging sweet spot similar to a cavity back club. The inventive club can accomplish this goal by incorporating a hollow interior cavity in the muscle portion of the club, supporting a thin hitting face with a supporting member, and adding a high density rear sole portion. Additionally, weight from the upper toe can be redistributed to other portions of the club head to improve mass characteristics, and can be advantageously replaced by a vibration and sound dampener. The end result of the present invention is a club that resembles a muscle back iron that low handicap players use, but the club plays like the forgiving cavity back irons that high handicap players prefer. Several embodiments of the present invention are described below.

Referring to FIGS. 1, 2, 3 and 4, a hollow iron-type golf head 10 comprises club head main body 12 including support 14, and muscle back shell 16. Support 14 and partial sole 18 of club head main body 12 are sized and dimensioned to fit flush with muscle back shell 16.

Club head main body 12 is preferably made from a lower density material than muscle back shell 16 to move club head center of gravity lower and further back to increase moment of inertia and sweet spot size to improve the golfer's chances for effective ball-striking. Preferably, main body 12 has a density in the range of about 4 g/cm$^3$ to about 8 g/cm$^3$ and muscle back shell 16 has a density in the range of about 9 g/cm$^3$ to about 19 g/cm$^3$. Suitable materials for club head main body 12 include, but are not limited to, aluminum, stainless steel or titanium and alloys thereof. Preferably, club head main body 12 is made from titanium alloy. Suitable materials for muscle back shell 16 include, but are not limited to, lead, tungsten, gold, or silver. Preferably, muscle back shell 16 is made from tungsten or tungsten nickel alloy. These material alternatives are applicable to all of the embodiments described herein. Preferably, materials with higher density, such as stainless steel and tungsten are located below and away from the center of gravity or the geometric center to enhance mass properties, e.g., larger rotational moment of inertia and lower center of gravity.

Figure 4:
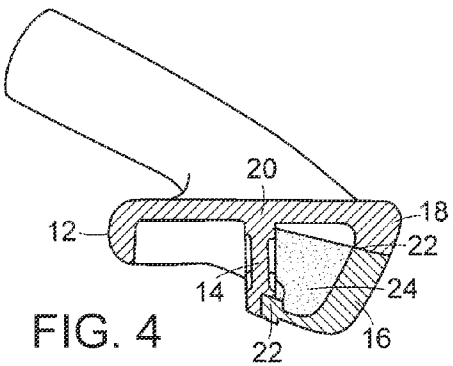
FIG. 4 is a cross-sectional view along line 4-4 of FIG. 1.

As discussed above, it is desirable to have a relatively thin hitting face so that extra mass can be redistributed. However, golf club and golf ball impacts can create a force of up to 2,000 lbs. Repeated impacts may adversely affect the structural integrity of hitting face 20. In accordance with an aspect of the present invention, support 14 is provided behind hitting face 20 to improve its mechanical integrity. While any number of supports can be deployed and the supports can be arranged in any orientation, it is preferred that a single support 14 is used and is positioned in the toe-to-heel direction. Furthermore, as best shown in FIG. 4 support 14 has an I-beam profile, which is known to have high structural integrity and resistance to bending forces while being relatively light weight. Alternatively, support 14 can have any profile including, but not limited to, square, triangular, rectangular, "X", "Y," circular, semi-circular, elliptical, etc.

Figure 1:
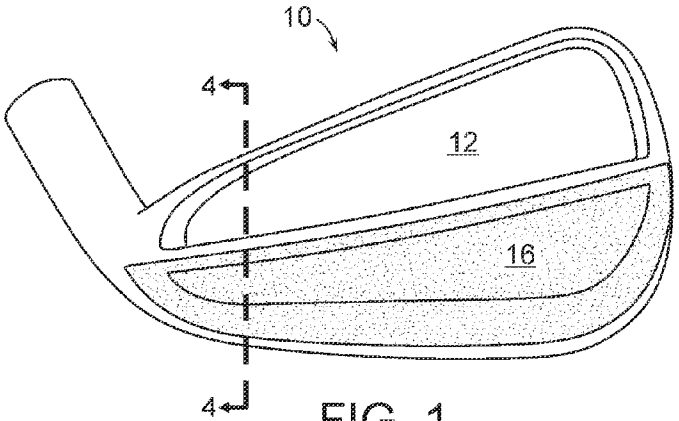
FIG. 1 is a rear view of a hollow iron-type golf club in accordance with the present invention.
Figure 1A:
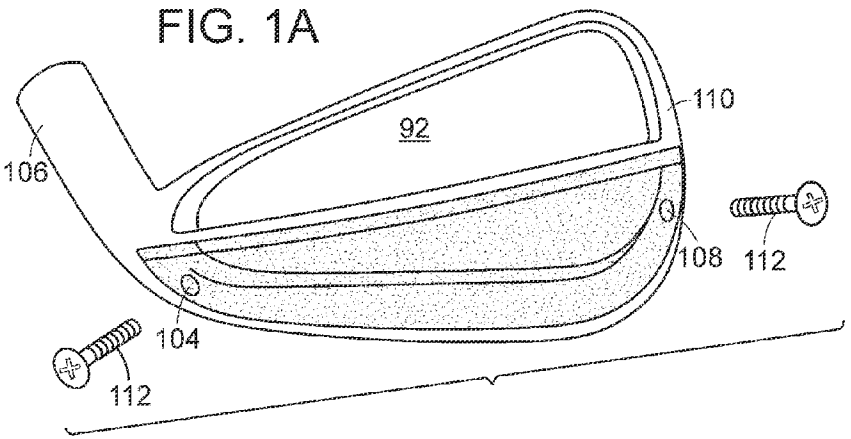
FIG. 1A is a perspective rear view of the club head main body without a muscle back shell.

To assemble club head 10, muscle back shell 16 is attached to support 14 and partial sole 18 of club head main body 12 at attachment lines 22 to define an enclosed cavity 24. Preferably, attachments 22 of muscle back shell 16 to club head main body 12 are made permanent by welding or force fitting with or without adhesive. Alternatively, shell 16 can be attached via fasteners 112, such as screws and rivets, and holes 98 as shown in FIG. 1A. An advantage of disposing attachments 22 away from hitting face 20 is that the high force of the golf club and golf ball impacts are less likely to cause mechanical failure of attachments 22. This advantage is applicable to all of the embodiments described herein. Preferably, plasma welding is used to attach the heel to main body 12 and laser welding is used to attach support 14 to hitting face 20 of main body 12.

Referring to FIG. 1A, an alternative embodiment comprises a bore 104 with internal threads in the heel below hosel 106 of club head main body 92, a bore 108 with internal threads in toe 110 of club head main body 92, or both. Internal threads of bores 104 and 108 fastenably mate with a fastener 112, such as a screw 112. The embodiment provides decorative aesthetics compatible with other embodiments discussed herein.

Referring to FIGS. 5 to 8A, another embodiment of golf head 10 comprises club head main body 32 including support 34 and optional toe dampener 46, and muscle back shell 36. Support 34 and partial sole 38 of club head main body 32 are sized and dimensioned to fit with muscle back shell 36. Toe dampener 46 is made from a viscoelastic material, such as urethane or other polymers, and provides weight redistribution in addition to vibration and sound attenuation when the golf club strikes a ball.

Club head main body 32 comprises upper back cavity 48, support 34 with first interlocking structure 60, recessed flange 50, partial sole 38 with second interlocking structure 62, and optional toe dampener 46 and cosmetic badge 76. In addition, club head main body 32 may have recess 52 in support 34 providing support 34 with an I-beam profile for weight redistribution to move lower and further back club head center of gravity. Support 34 can be cast or forged integral with hitting face 20 and/or club head main body 32 as a monolithic body, or can be manufactured separately as a different material or same material, such as stainless steel or carbon fiber reinforced plastics, and later attached to hitting face 20 via welding or by interference fit with tension.

Muscle back shell 36 comprises back flange 54 with third interlocking structure 64 and sole section 56 with fourth interlocking structure 66. In addition, muscle back shell 36 may have recess 58 in back flange 54 for weight redistribution to move lower and further back club head center of gravity.

Figure 5:
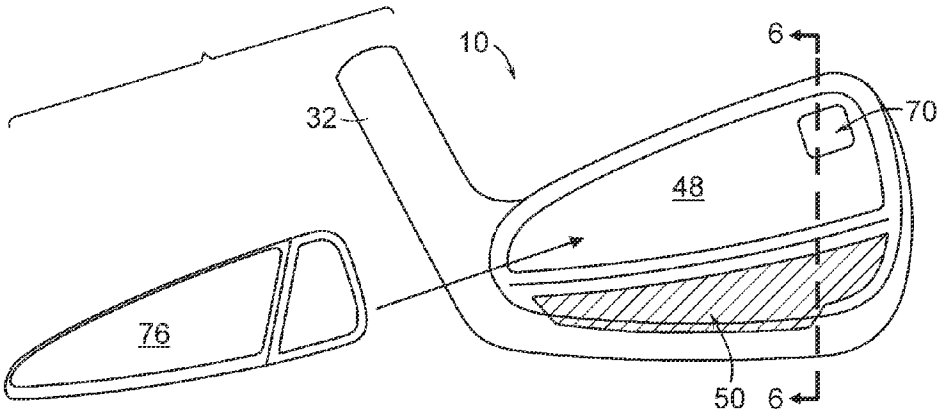
FIG. 5 is an exploded rear view of another inventive club head, optional toe dampener, muscle back shell, and optional cosmetic decal.
Figure 7:
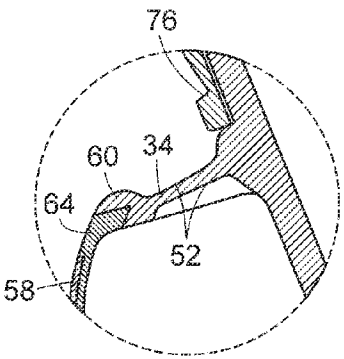
FIG. 7 is an enlarged view of the circled portion of FIG. 6.
Figure 6:
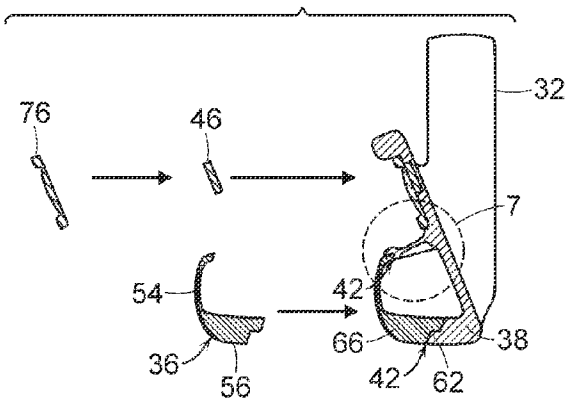
FIG. 6 is an exploded cross-sectional view along line A-A of FIG. 5.

First interlocking structure 60 of support 34 and second interlocking structure 62 of partial sole 38, of club head main body 32, are sized and dimensioned to mate with third interlocking structure 64 of back flange 54 and fourth interlocking structure 66 of sole section 56, of muscle back shell 36, respectively. While any number of interlocking structures can be deployed and the interlocking structures can be arranged in any orientation, it is preferred that a single notch is disposed in support 34 and partial sole 38 and is positioned in the toe-to-heel direction to mate with corresponding interlocking structures 64 and 66, as shown in FIGS. 5 and 7. Alternatively, interlocking structures 60, 62, 64, and 66 can have any profile including, but not limited to, square, triangular, rectangular, curvilinear, sine wave, serrated, etc. Depending on the shape, and in particular the profile in cross section, of the interlocking structures, both increased surface area contact and increased mechanical binding is achieved between club head main body 32 and muscle back 36 when fit together. An advantage of this embodiment is that the shape of interlocking structures 60, 62, 64, and 66 can be matched to other club decorative aesthetics, such as the hosel.

Figure 8:
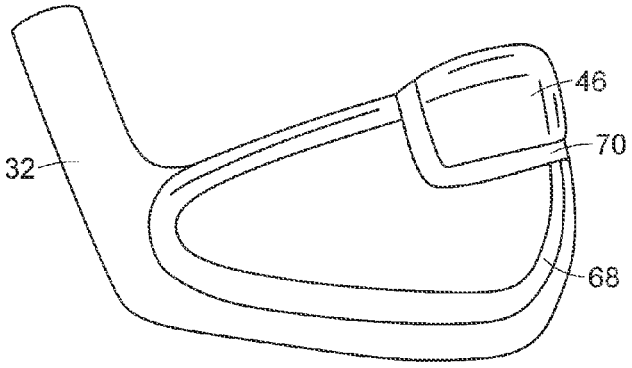
FIG. 8 is a perspective view of the toe dampener using a thinned area.
Figure 8A:
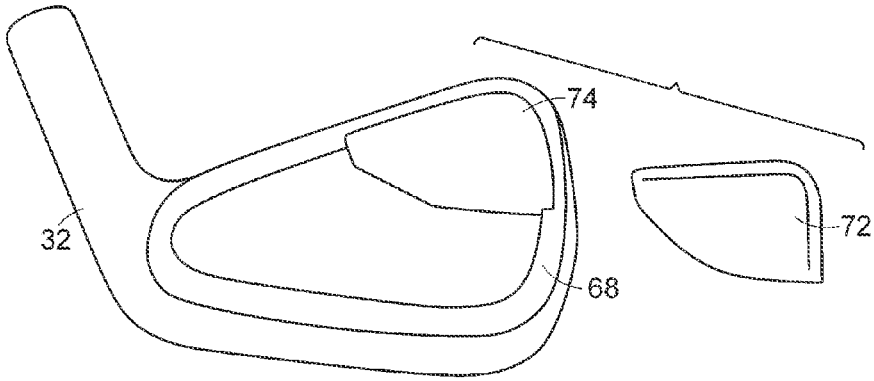
FIG. 8A is a perspective view of the toe dampener using a slot.
Figure 9:
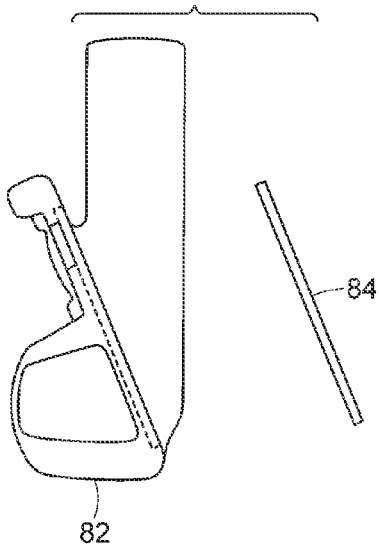
FIG. 9 is an exploded cross-sectional view of another embodiment of the hollow iron-type golf club.

Referring to FIGS. 8-9, by removing mass, in the form of titanium alloy or other suitable material as discussed above, from toe 68 of club head main body 32 and replacing the material, as toe dampener 46, with a lower density material club head center of gravity is moved lower and further back, while also providing vibration and sound attenuation when the golf ball is mis-hit on toe 68 of the golf club. Preferably, toe dampener 46 is made from a soft viscoelastic material such as thermoplastic elastomer, rubber, or polyurethane that has a density in the range of about 0.8 g/cm$^3$ to about 1.5 g/cm$^3$ and Shore A40-A90 hardness rating. Preferably, toe dampener 46 is created by thinning an area 70 in toe 68 on the back of club head main body 32, as shown in FIG. 8. Alternatively, thinned area 70 is in upper back cavity 48. In either case, thinned area 70 is replaced with viscoelastic toe dampener 46. An alternative embodiment comprises a lightweight member 72 made of viscoelastic material that is inserted into a slot 74 created in toe 68 of club head main body 32, as shown in FIG. 8A. Slot 74 can also be formed in the middle of the topline of the club head. Alternatively, a combination of thinned areas and slots may be used to add viscoelastic material to club head main body 12.

Toe dampener 46 viscoelastic material provides vibration attenuation that reduces the distance and off-line penalties, and unpleasant sensation radiating up the shaft into the hands and arms of the golfer when a ball is mis-hit on toe 68 of club head main body 32. Furthermore, golf balls mis-hit on high toe 68 cause a low frequency ("bass"), high amplitude ("loud") noise. The viscoelastic material in toe dampener 46 provides sound attenuation that generates an aesthetically pleasing sound when a golf club strikes a ball. Additionally, the number of high toe mis-hits is statistically low therefore less metal is required at that location and the metal can be replaced with lower density polymers.

Finally, optional cosmetic badge 76 adheres to the upper back cavity 48 of the club head main body 32. If toe dampener 46 is produced by thinning an area 70 as shown in FIG. 8, then cosmetic badge 76 holds toe dampener 46 captive against back of club head main body 32. In addition to the current embodiment, toe dampener 46 and cosmetic badge 76 are applicable to all the embodiments discussed herein.

To assemble club head 10, muscle back shell 36 is attached to support 34 and partial sole 38 of club head main body 32. Preferably, attachments 42 of muscle back 36 to club head main body 32 are made permanent by welding, fasteners or force fitting with or without adhesive, as discussed above.

Referring to FIG. 9, another embodiment of club head 10 comprises separate face plate 84 that is welded to club head main body 82 rather than being made integral. An advantage of this embodiment is that the style and/or density of face plate 84 can be changed without modifying the rest of club head 10.

Figure 10:
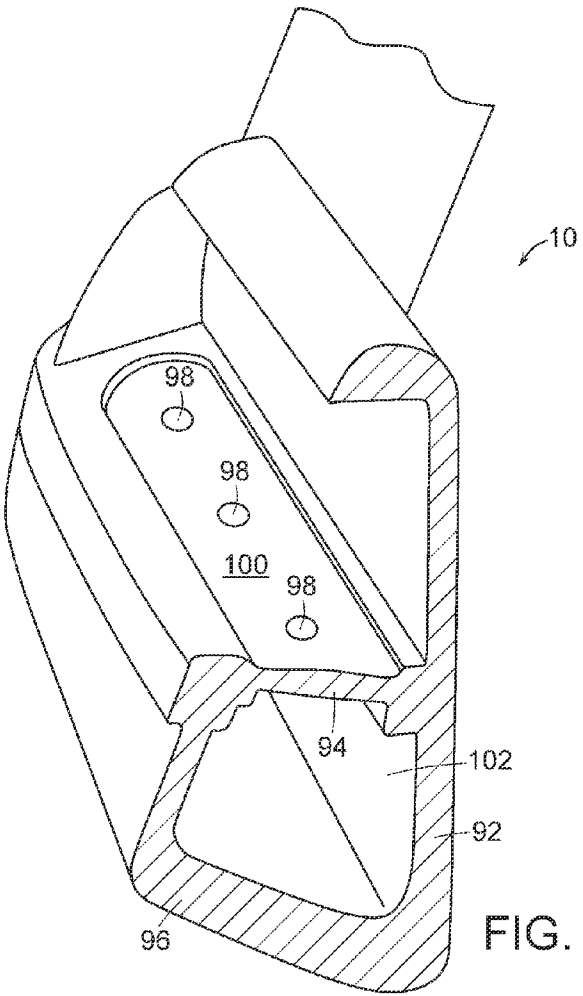
FIG. 10 is an enlarged cross-sectional view of another embodiment of the hollow iron-type golf club.

Referring to FIG. 10, another embodiment of golf head 10 comprises holes or openings 98 on top surface 100 of support 94 of club head main body 92. Internal cavity 102 formed by club head main body 92 and muscle back shell 96 can be filled with material including, but not limited to, foamed or unfoamed polyurethane, or other substance, to prevent water, or other material, from entering otherwise hollow cavity 102. The material can be transparent or translucent, clear or colored, and may have multiple colors exposed through openings 98. Hollow cavity 102 can be filled through openings 98. While any number of holes can be deployed and the holes can be arranged in any orientation, it is preferred that three holes 98 are used and are positioned in the toe-to-heel direction. Alternatively, holes can have any arrangement including, but not limited to, diamond, oval, etc. An advantage of using filling material is to increase the dampening effect and to provide additional aesthetics to the club head, allowing the user to look into the muscle back. Hollow cavity 102 may not be filled completely. Instead, a material can be added into hollow cavity 102 to bring the club head to any desired weight during manufacturing. For example, up to 6 grams of mass can be added to bring the weight of the club head to regulation weight. Suitable added mass includes, but is not limited to an adhesive commonly known in the art as rat glue.

Top surface 100 can be a recessed surface, as illustrated in FIG. 10. The recess can be filled with a three-dimensional insert, which can be a filler or can serve as a badge carrying marketing indicia or a bridge. The insert can have any shape and can have an L-shape. The insert can also be functional, e.g., to dampen vibration from impacts with golf balls. Suitable dampening materials include, but are not limited to, soft polymers having hardness value from Shore A30 to Shore A90, preferably from Shore A35 to Shore A60. The functional insert can carry sensors and or electronics to measure location of impacts on the hitting face. In one embodiment, the sensors are located on or proximate to the hitting face and the electronics including memory, such as EEPROM and other memory storage devices, is located proximate to the grip of the club to minimize vibration to the sensitive electronics.

Figure 11:
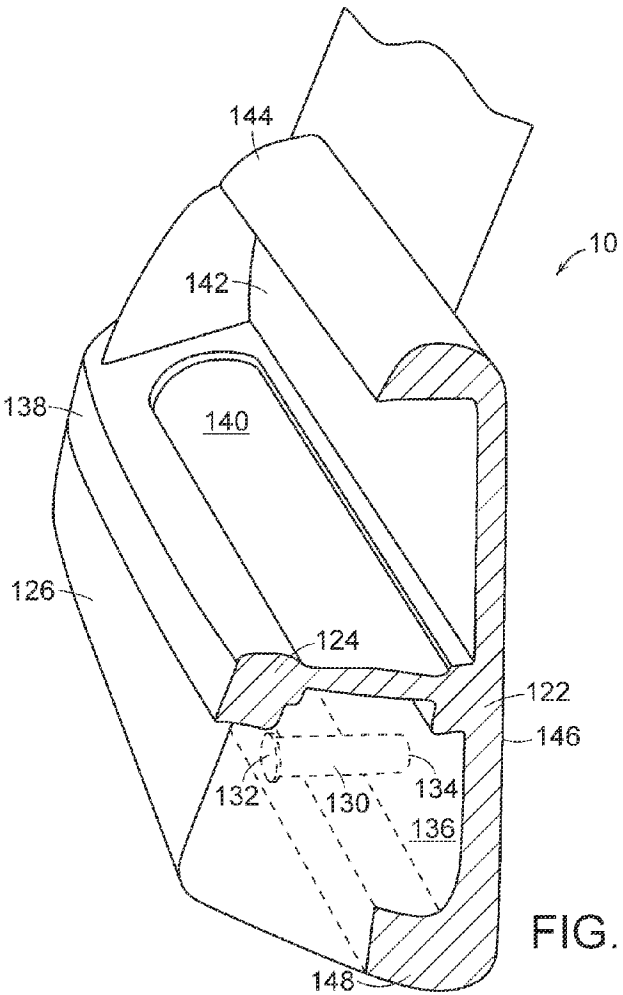
FIG. 11 is an enlarged cross-sectional view of another embodiment of the hollow iron-type golf club.
Figure 11A:
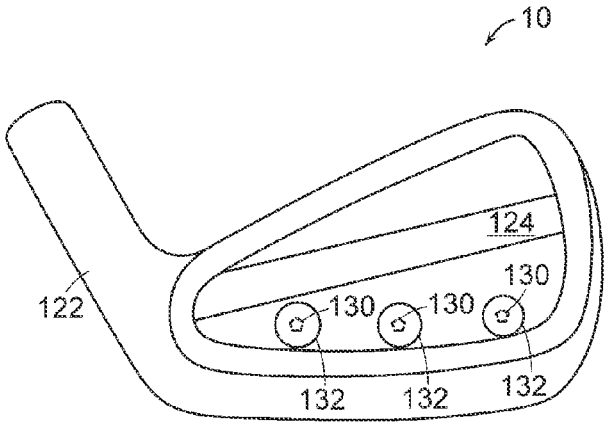
FIG. 11A is a perspective rear view of the club head main body.

Referring to FIGS. 11-11A, another embodiment of club head 10 comprises posts 130 projecting from back 136 of club head main body 122. Posts 130 comprise enlarged heads 132 that provide mounting attachments, or anchors, for muscle back solid 126 disposed on top of posts 130 and support 124 projecting from back 136 of main body 122. Suitable materials for posts 130 include, but are not limited to, lead, tungsten, gold, or silver. Preferably, posts 130 are made from tungsten nickel alloy. Posts 130 are custom milled, as needed, for weight distribution, to move the center of gravity lower and further back. Preferably, enlarged heads 132 have a disk shape as shown in FIGS. 11-13A, or any other suitable shape, such as cube, octahedron, sickle, boat anchor, etc. Whereas suitable material for making translucent overcast of muscle back solid 126 may include, but is not limited to, polyurethane, or similar substance, made into any color, design, logo, etc.

Figure 12:
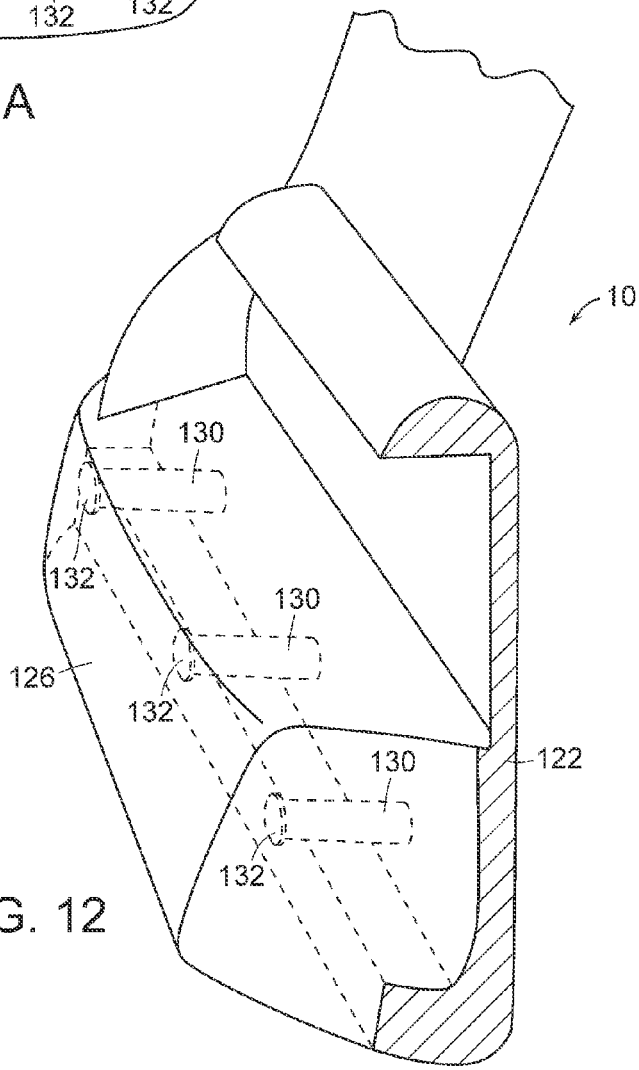
FIG. 12 is an enlarged cross-sectional view of another embodiment of the hollow iron-type golf club.

To assemble club head 10, posts 130 are attached to back 136 of club head main body 122 at attachment lines 134. Preferably, attachments 134 of posts 130 to club head main body 122 are made permanent by welding, fasteners or adhesive. Then, the mold for making muscle back solid 126 is created with club head main body 122 forming a part of the mold. Main body 122 connects with a half-mold that would create muscle back 126. While any number of posts can be deployed and the posts can be arranged in any orientation, it is preferred that three posts 130 are used and are positioned in the toe-to-heel direction to move the center of gravity low to the ground. Alternatively, posts can have any arrangement including, but not limited to, square, triangular, rectangular, curvilinear, diamond, oval, etc. An alternative embodiment comprises no support as shown in FIG. 12.

Figure 13A:
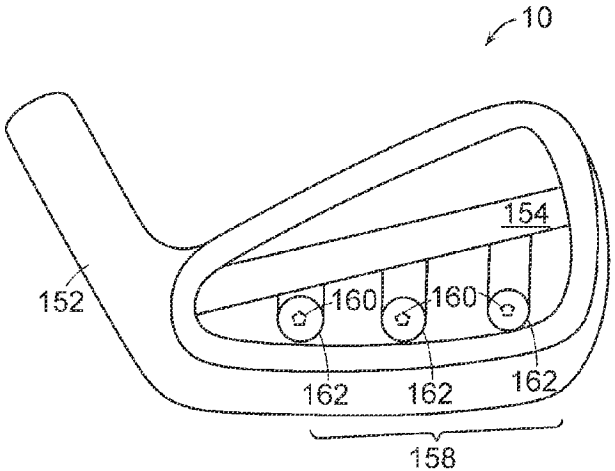
FIG. 13A is a perspective rear view of the club head main body.
Figure 13:
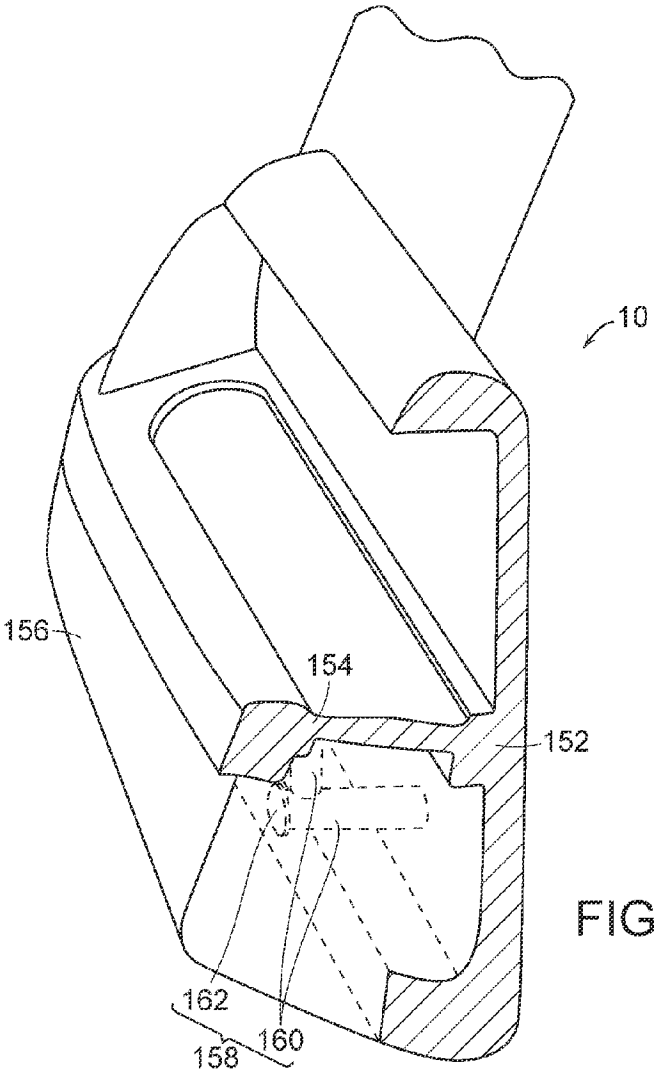
FIG. 13 is a cross-sectional exploded view of another embodiment of the hollow iron-type golf club.

Referring to FIGS. 13-13A, another alternative embodiment comprises a honeycomb system 158 of many interconnected anchors 160 and enlarged heads 162 attached to support 154 and back of club head main body 152. Muscle back solid 156 is a translucent overcast disposed on top of honeycomb system 158. In manufacturing club head 10, honeycomb system 158 of club head main body 152 is part of the mold, as discussed above.

All the main bodies of the golf head embodiments, discussed above, may be constructed from a cast or forged material, such as, for example, stainless steel 431, or 1025 carbon steel.

The present invention also includes iron-type golf clubs that provide advantageous frequency behavior over conventional iron-type golf clubs. They provide increased frequency value behavior, which provides a user of the golf clubs with better feel and sound, especially in the lower frequency modes. That improved feel and sound improves the feedback provided to the player indicating optimal ball impact with the hitting face of the golf club.

The golf clubs of the present invention include a club main body, a supporting member and a muscle back shell and vibration modes having increased frequency values over conventional iron-type golf clubs. The frequency value for the first vibration mode is preferably greater than 4000 Hz, and more preferably greater than 4400 Hz. Additionally, the frequency value for the second vibration mode is preferably greater than 5000 Hz, and more preferably greater than 5500 Hz. Still further, the frequency value for the third vibration mode is preferably greater than 7400 Hz, and more preferably greater than 7700 Hz.

Table 1, shown in FIG. 14, provides a comparison between the frequency values of the first ten vibration modes of exemplary 6-irons for a conventional iron-type golf club, such as a Titleist 704 iron-type golf club, and two embodiments of the iron-type golf club of the present invention, Embodiments A and B. Embodiment A corresponds to an iron-type golf club that includes a main body that is cast in 431 stainless steel with a supporting member that is integrally cast with the main body. Embodiment A also includes a muscle back shell constructed from a tungsten nickel alloy that is welded to the rear portion of the main body and the supporting member to define an enclosed cavity. Embodiment B corresponds to an iron-type golf club that includes a main body that is forged from 1025 carbon steel with a supporting member that is integrally forged with the main body. Embodiment B also includes a muscle back shell constructed from a tungsten nickel alloy that is welded to the rear portion of the main body and the supporting member.

As shown in Table 1, the frequency values for the majority of vibration modes of the embodiments of the present invention are significantly increased over corresponding frequency values for the conventional iron-type golf club. For example, Embodiment A provides increased frequency values for a majority of the vibration modes and Embodiment B provides greater frequency values for each of the first ten vibration modes. Both Embodiments A and B exhibit increases in frequency value for the two lowest frequency vibration modes that are greater than the frequencies exhibited by a conventional iron-type golf club by more than 10%. As a result, the embodiments provide a user with sound and feel that are significantly improved over the sound and feel of the conventional iron-type golf club.

Figure 15A:
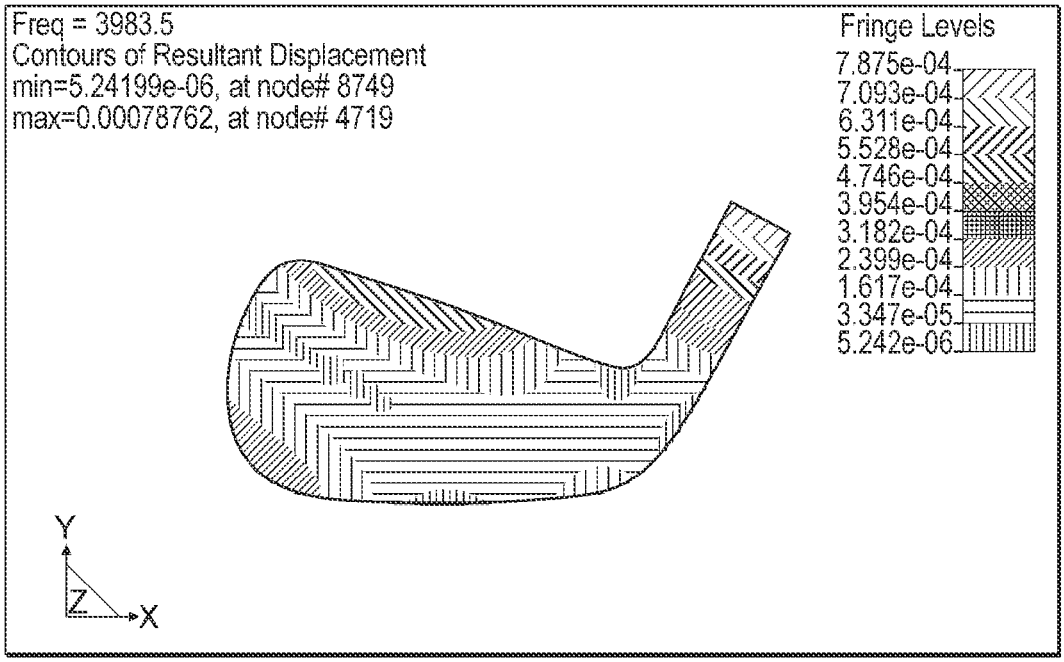
FIGS. 15A-15C illustrate first mode shapes for a conventional iron-type golf club and embodiments of the iron-type golf club according to the present invention.
Figure 15B:
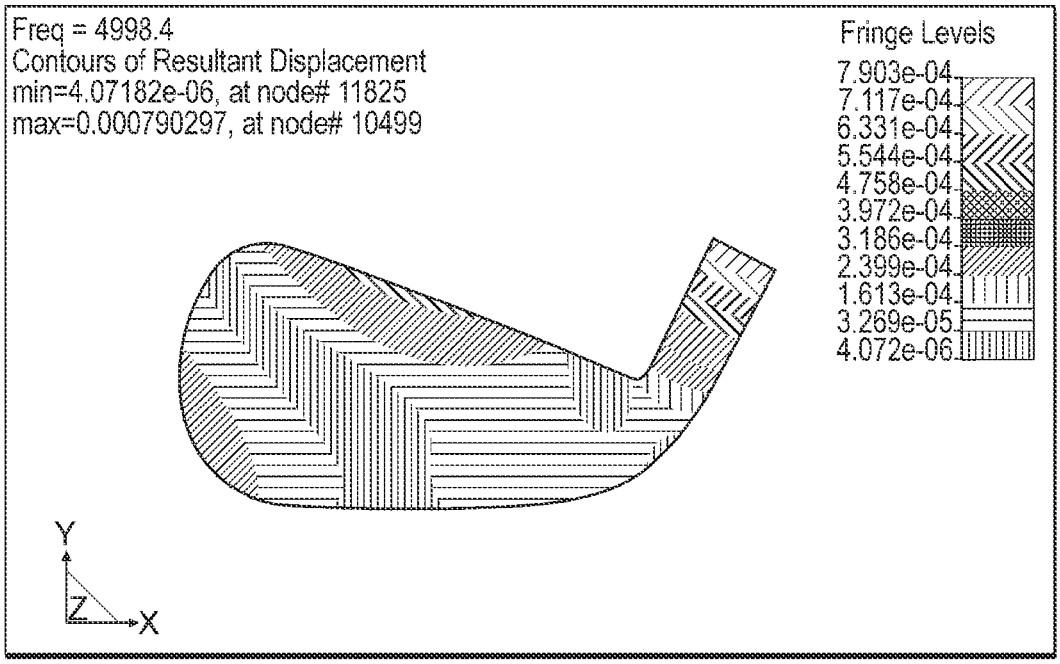
Figure 15C:
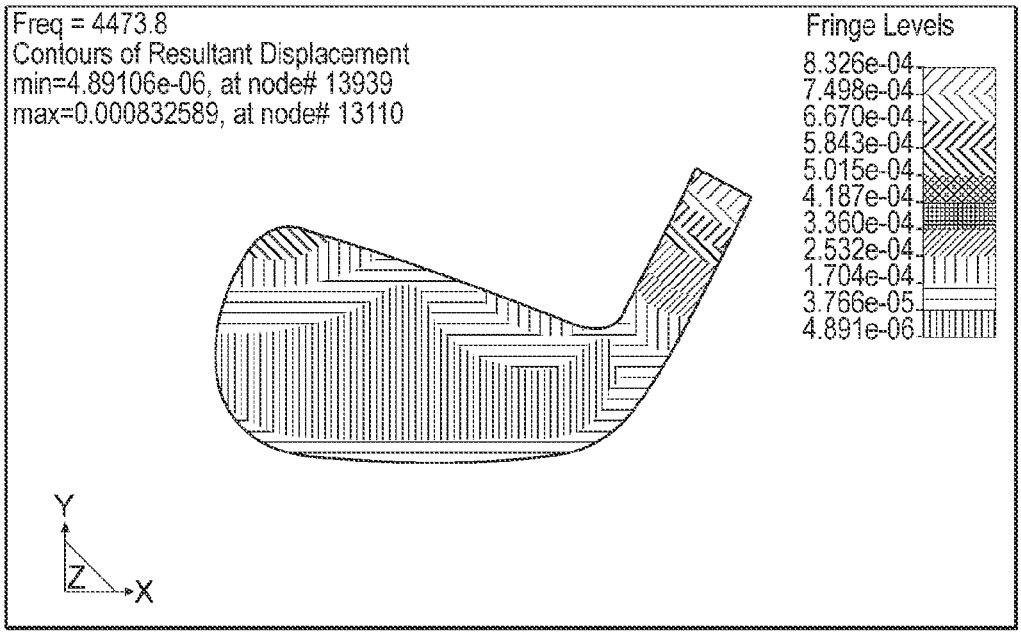

In the first vibration mode, Embodiments A and B exhibit mode shapes that are similar to the first mode shape of the conventional iron-type golf club head, as shown in FIGS. 15A-15C. However, the frequency value at which that behavior takes place is significantly increased for each of the embodiments of the present invention. In particular, Embodiment A has a first mode frequency value of approximately 4998.4 Hz, which is approximately a 26% increase over that of the conventional iron-type golf club. Embodiment B exhibits the first mode behavior at a frequency value of approximately 4473.8 Hz, which is approximately a 12% increase over the first mode frequency value of the conventional golf club at 3983.5 Hz.

Figure 16A:
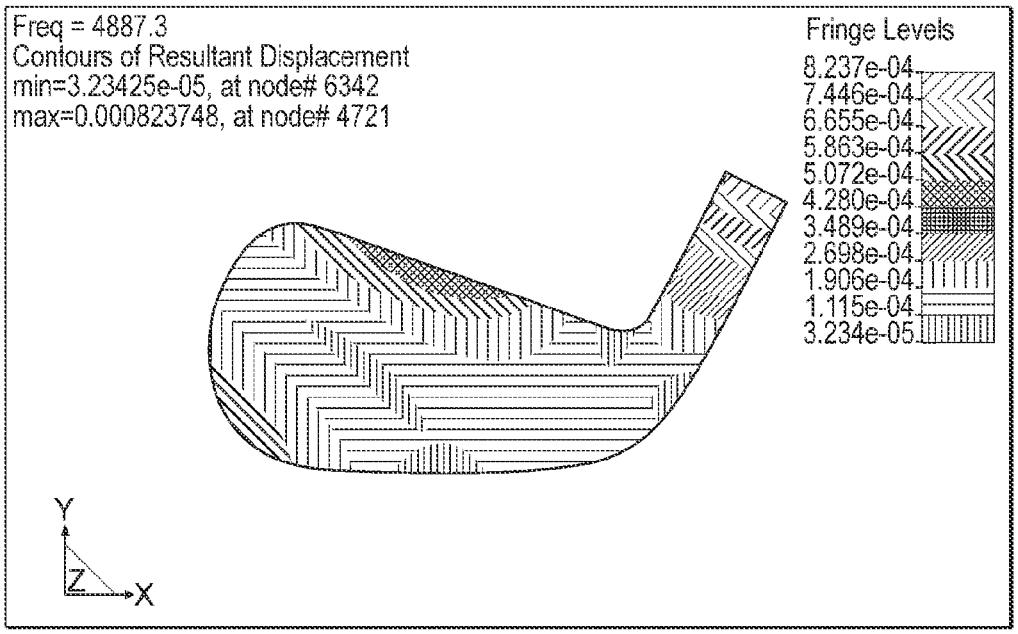
FIGS. 16A-16C illustrate second mode shapes for a conventional iron-type golf club and embodiments of the iron-type golf club according to the present invention.
Figure 16B:
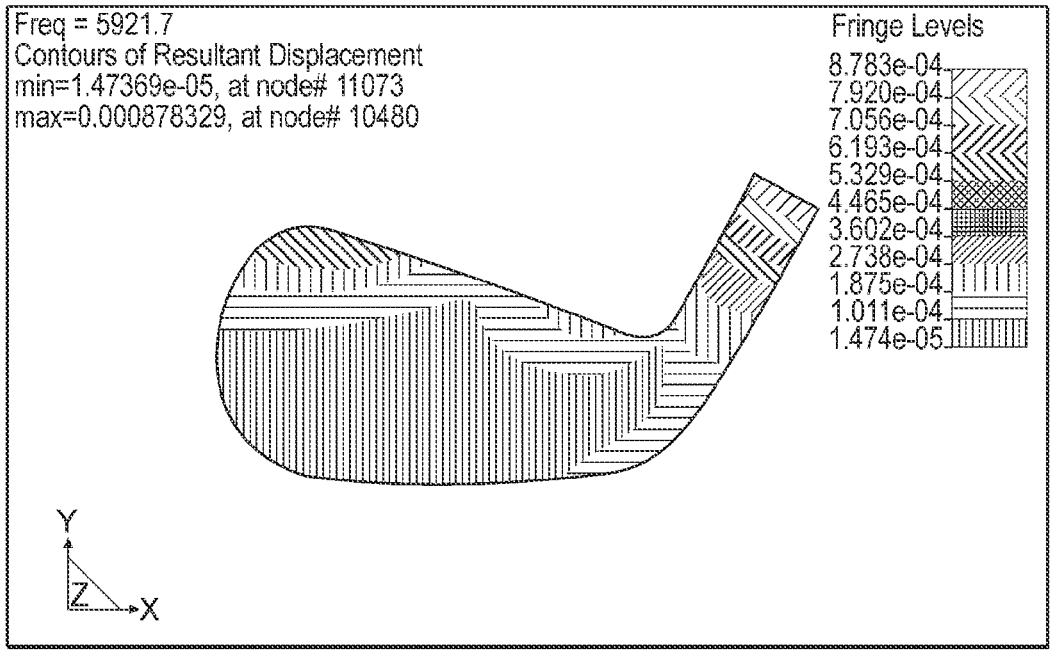
Figure 16C:
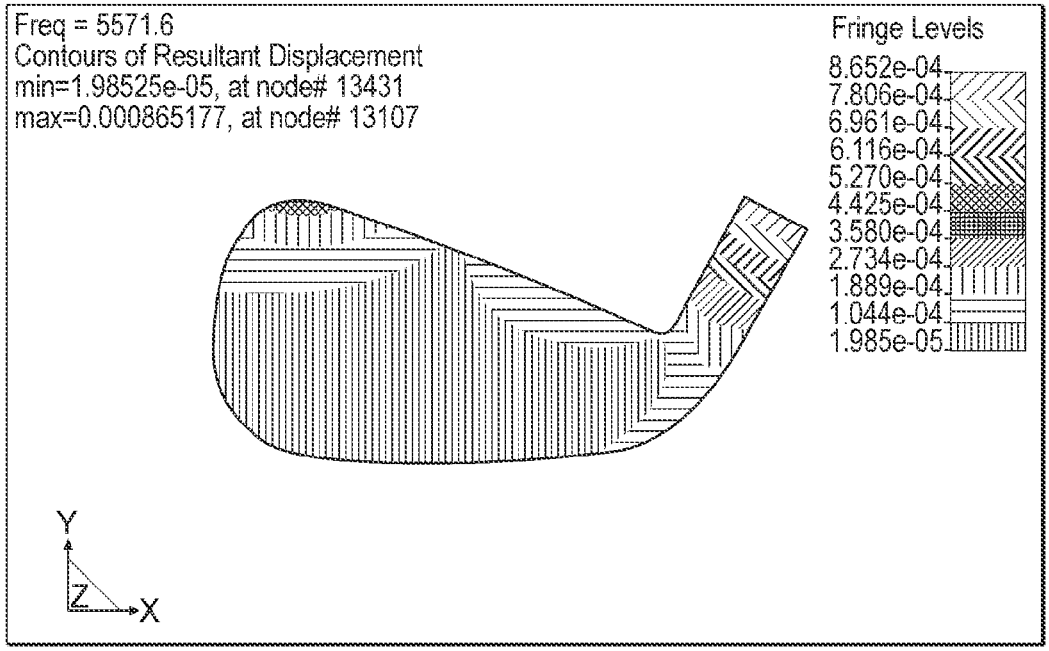

Referring to FIGS. 16A-16C, Embodiments A and B also provide second mode shapes that are similar to the second mode shape exhibited by the conventional iron-type golf club. However, the second mode frequency values of Embodiments A and B are greater than the second mode frequency value for the conventional club. In particular, Embodiments A and B have second mode frequency values of 5921.7 Hz and 5571.6 Hz, respectively, while the conventional golf club head exhibits a second mode frequency value of 4887.3 Hz.

Figure 17A:
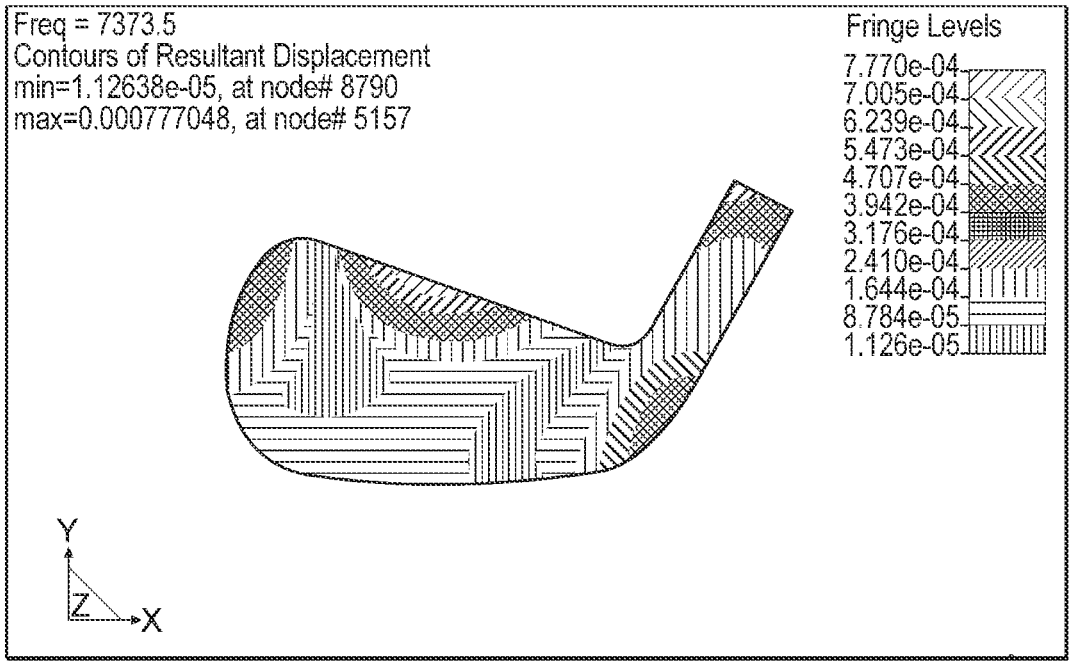
FIGS. 17A-17C illustrate third mode shapes for a conventional iron-type golf club and embodiments of the iron-type golf club according to the present invention.
Figure 17B:
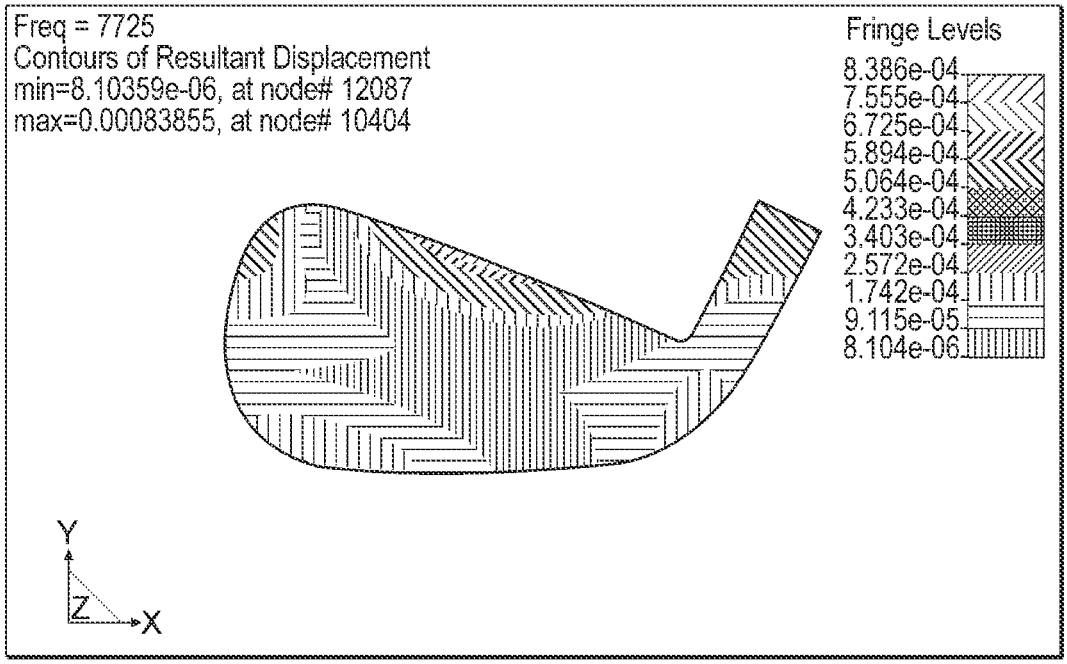
Figure 17C:
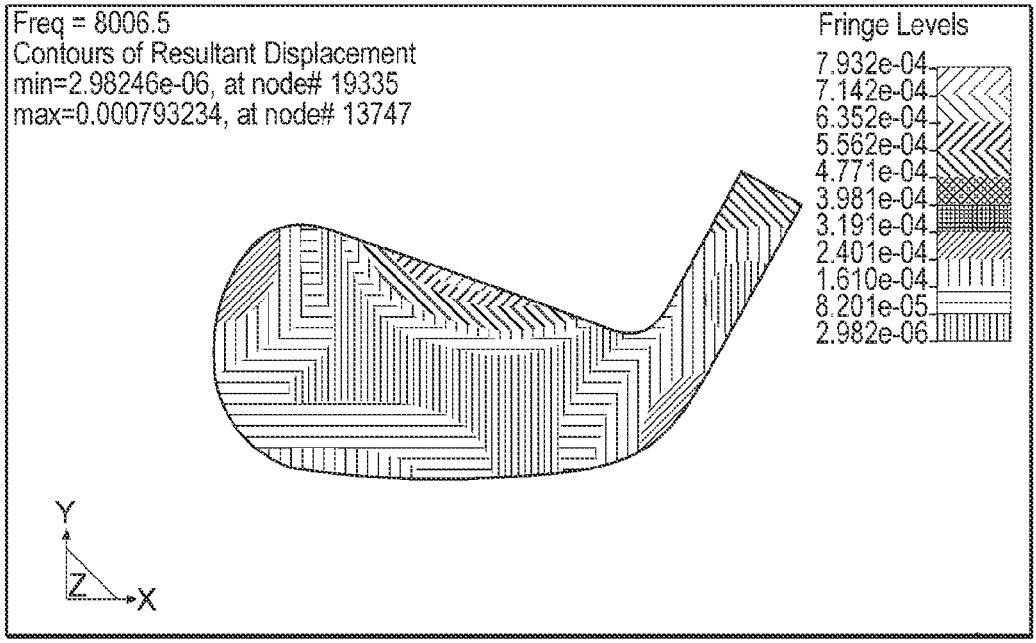

Referring to FIGS. 17A-17C, in the third vibration mode, the mode shape of the embodiments of the present invention deviate from the third mode shape of the conventional iron-type golf club. Unlike the conventional iron-type golf club, the embodiments of the present invention include a single minimum deflection region that extends generally across the hitting face of the golf club in a heel to toe direction. The conventional golf club includes a pair of minimum deflection regions that are spaced from one another in a heel to toe direction, as shown in FIG. 17A. As a result, in the third vibration mode, the center of the hitting face of the conventional golf club has a larger amplitude of displacement than the center of the hitting face of golf clubs in accordance with the present invention.

Additionally, the frequency values of the third vibration mode of Embodiments A and B are increased over that of the conventional iron-type golf club. The frequency value of the third vibration mode of Embodiment A is 7725 Hz, which is approximately a 5% increase over the frequency value of the conventional iron at 7373.5 Hz. Embodiment B has a third mode frequency value of 8006.5, which is approximately a 9% increase over the frequency value of the conventional iron.

Figure 18A:
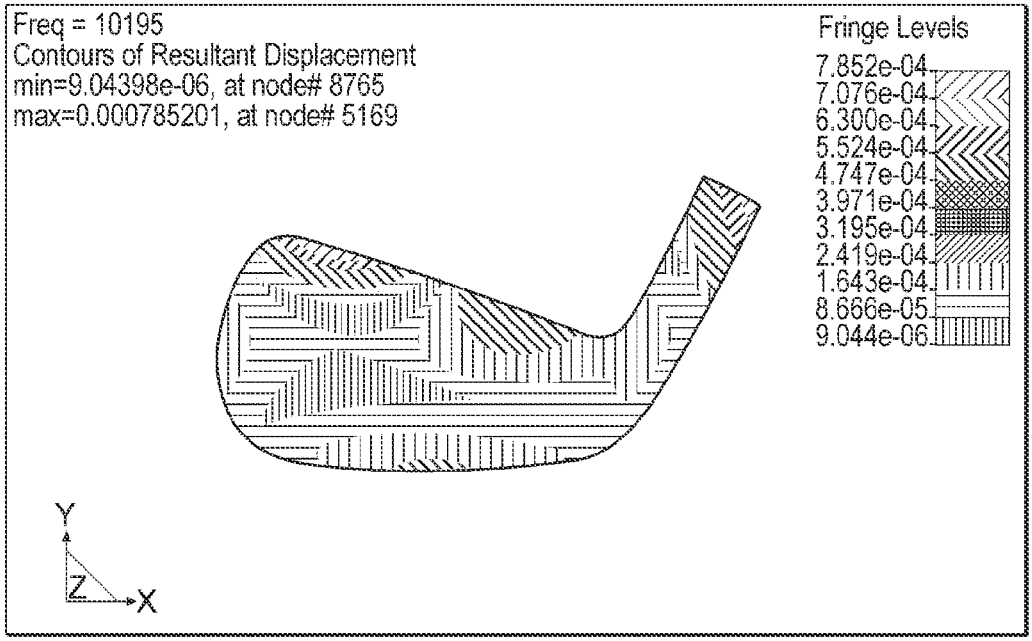
FIGS. 18A-18C illustrate fourth mode shapes for a conventional iron-type golf club and embodiments of the iron-type golf club according to the present invention.
Figure 18B:
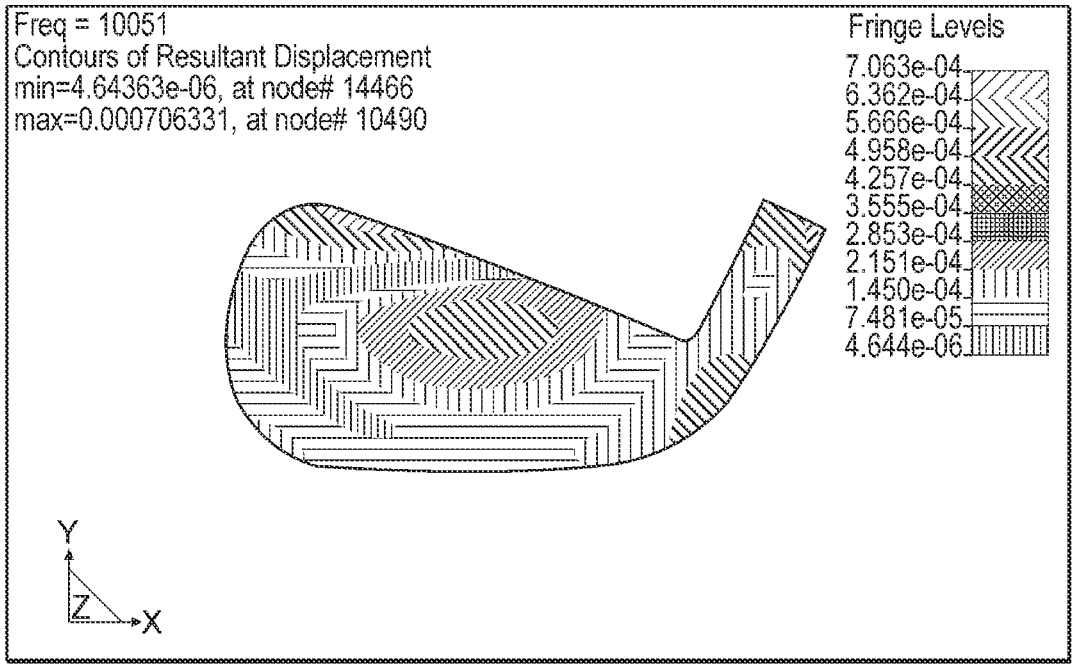
Figure 18C:
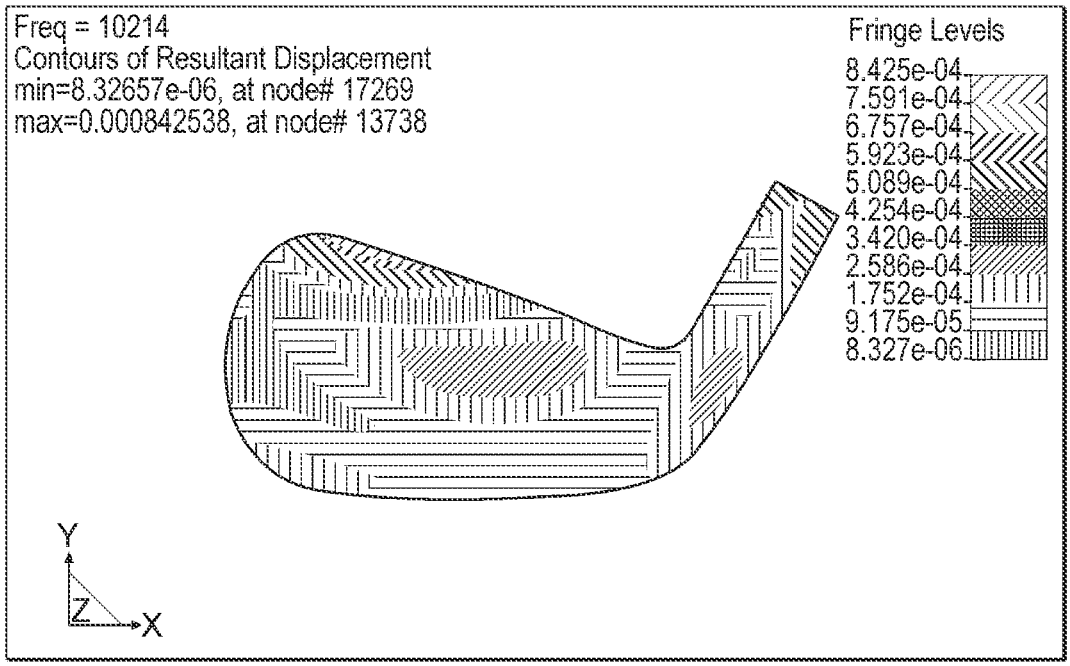

Referring to FIGS. 18A-18C, the fourth mode frequency values of the conventional iron-type golf club head and Embodiments A and B are similar but the mode shape of Embodiments A and B differ from the shape of the conventional golf club. In particular, the minimum deflection regions of Embodiments A and B are disposed further toward the toe than the regions of minimum deflection of the conventional iron-type golf club. Additionally, each of Embodiments A and B includes a region of maximum deflection that is disposed approximately adjacent the center of the hitting face of the respective golf club.

Figure 19A:
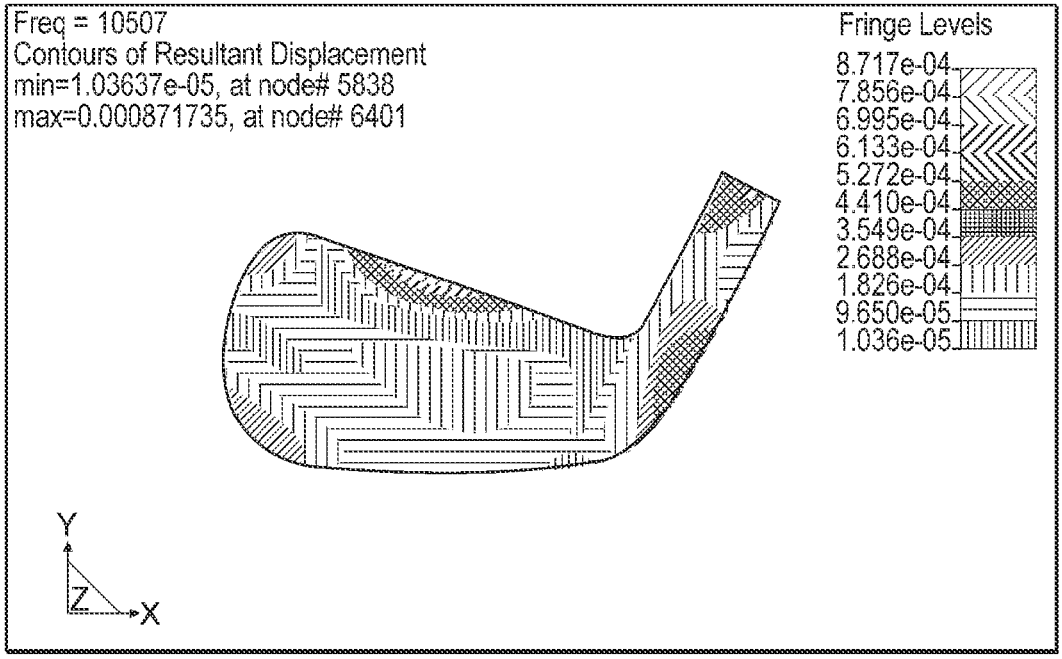
FIGS. 19A-19C illustrate fifth mode shapes for a conventional iron-type golf club and embodiments of the iron-type golf club according to the present invention.
Figure 19B:
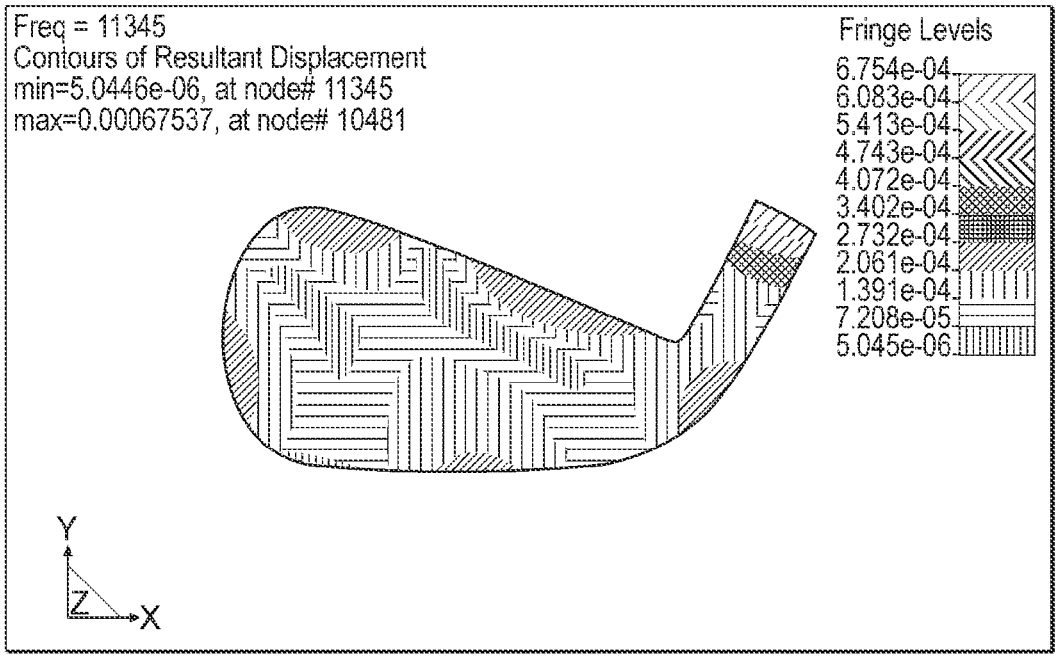
Figure 19C:
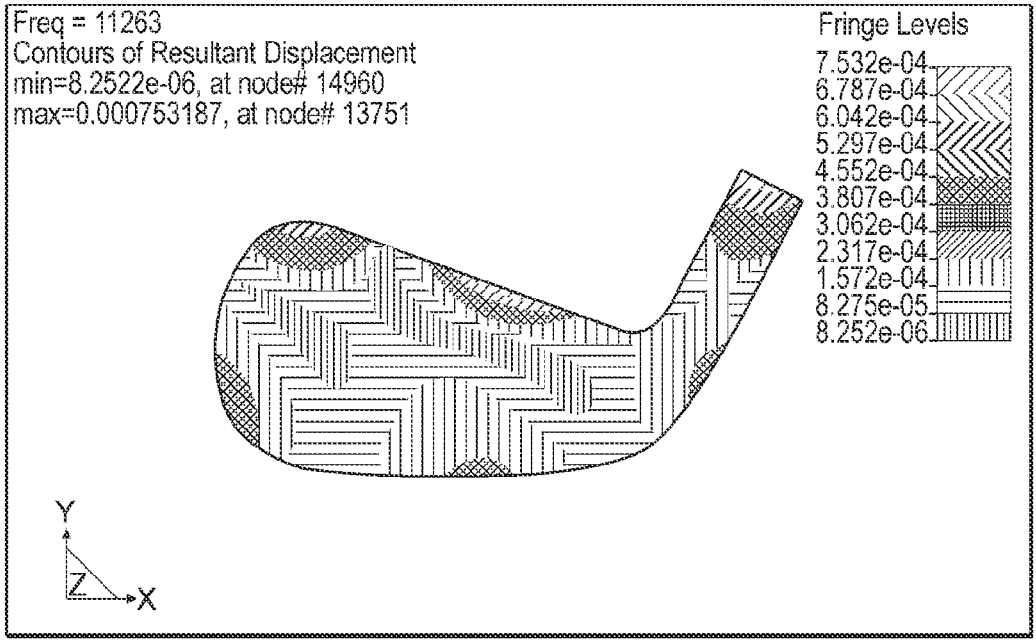

In the fifth vibration mode, the embodiments of the present invention provide increased frequency values in addition to different mode shapes as compared to the conventional iron-type golf club. The fifth mode frequency value of Embodiment A is 11345 Hz, which is approximately an 8% increase over the fifth mode frequency value of the conventional iron-type golf club at 10507 Hz. Similarly, the fifth mode frequency value of Embodiment B is 11263 Hz, which is approximately a 7% increase over the fifth mode frequency value of the conventional golf club. Additionally, the embodiments of the present invention have regions of high deflection that are disposed toward the sole from the center of the club face, while the conventional golf club includes a region of high deflection that is located approximately at the center of the hitting face of the golf club, as shown in FIGS. 19A-19C.

Figure 20A:
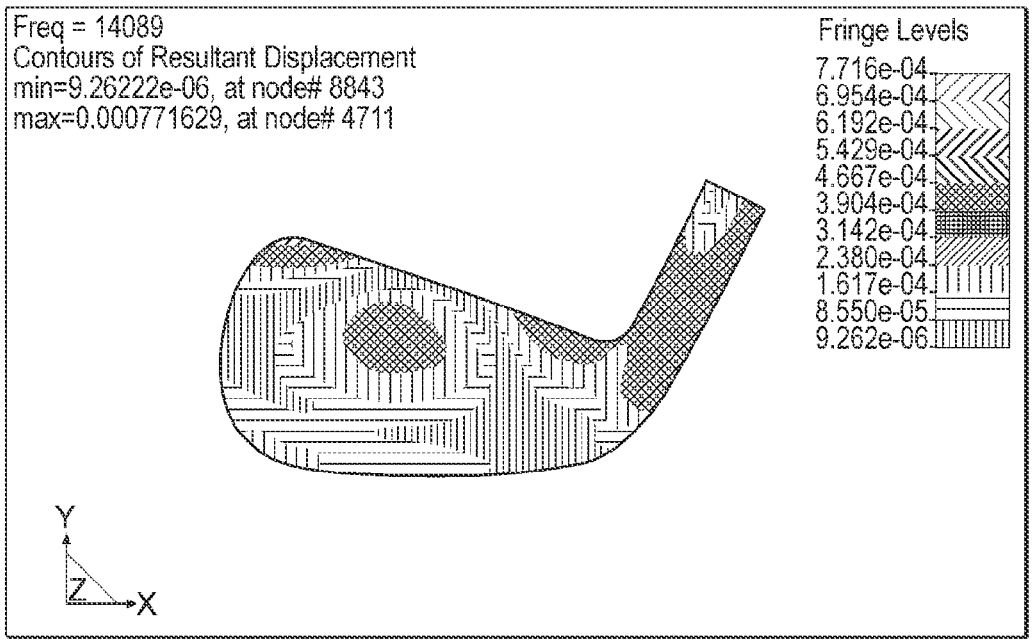
FIGS. 20A-20C illustrate sixth mode shapes for a conventional iron-type golf club and embodiments of the iron-type golf club according to the present invention.
Figure 20B:
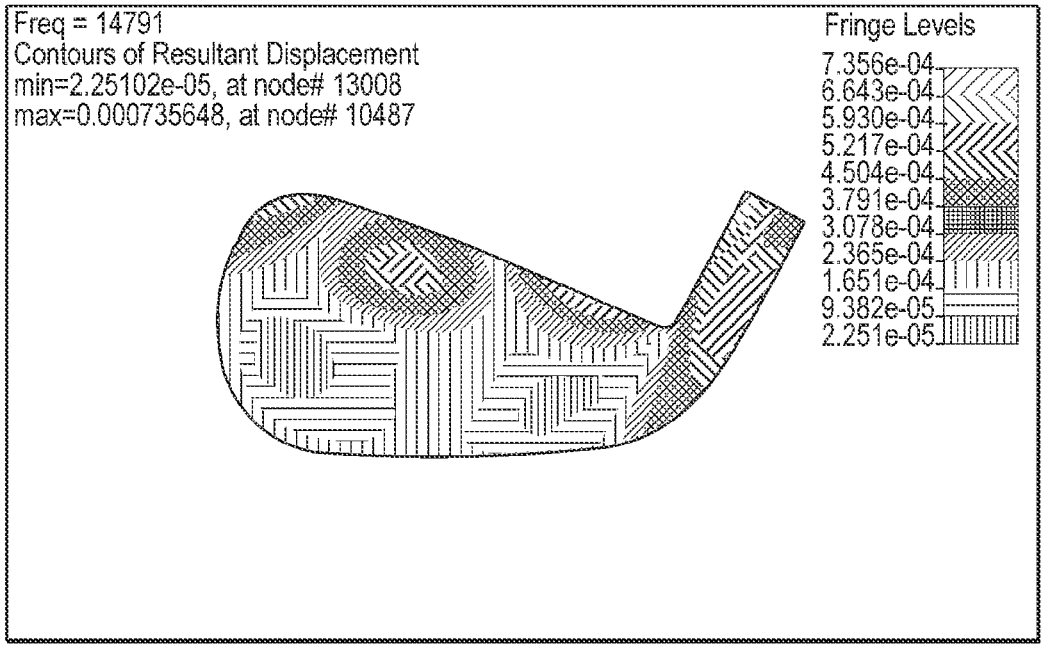
Figure 20C:
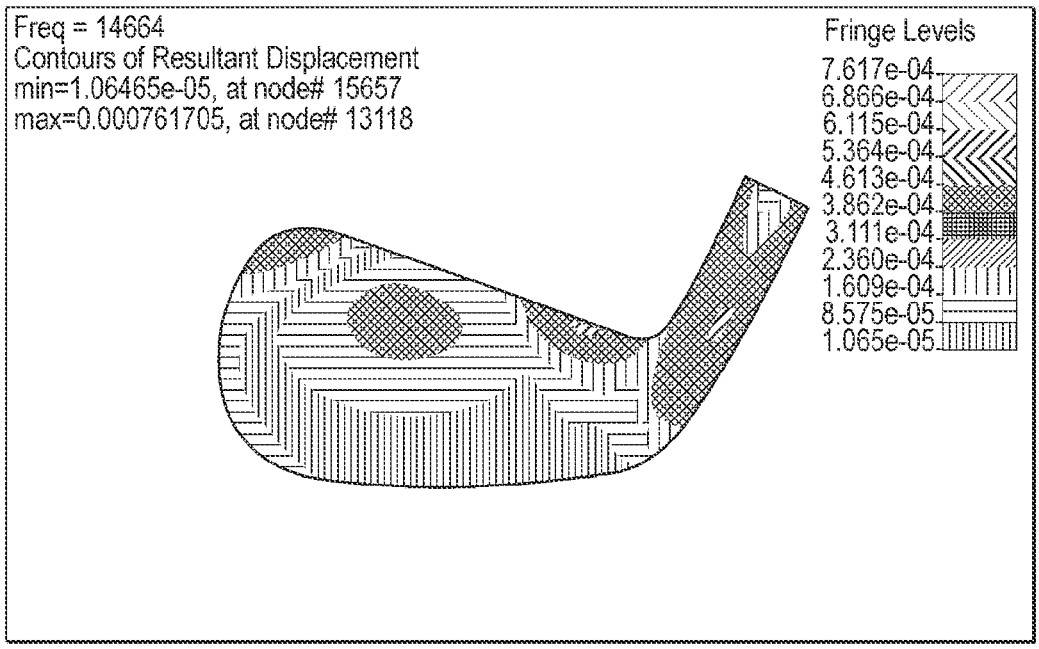

Referring to FIGS. 20A-20C, the sixth vibration mode shapes of Embodiments A and B and the conventional iron-type golf club are similar, however, the frequency values of that mode are greater for the embodiments of the present invention than the frequency value for the conventional iron-type golf club. Embodiment A exhibited a frequency value of 14791 Hz which is 5% greater than the frequency value of the conventional iron-type golf club, at 14089 Hz. Similarly, Embodiment B exhibited a frequency value of 14664 Hz, which is a 4% increase over that of the conventional iron-type golf club.

Figure 21A:
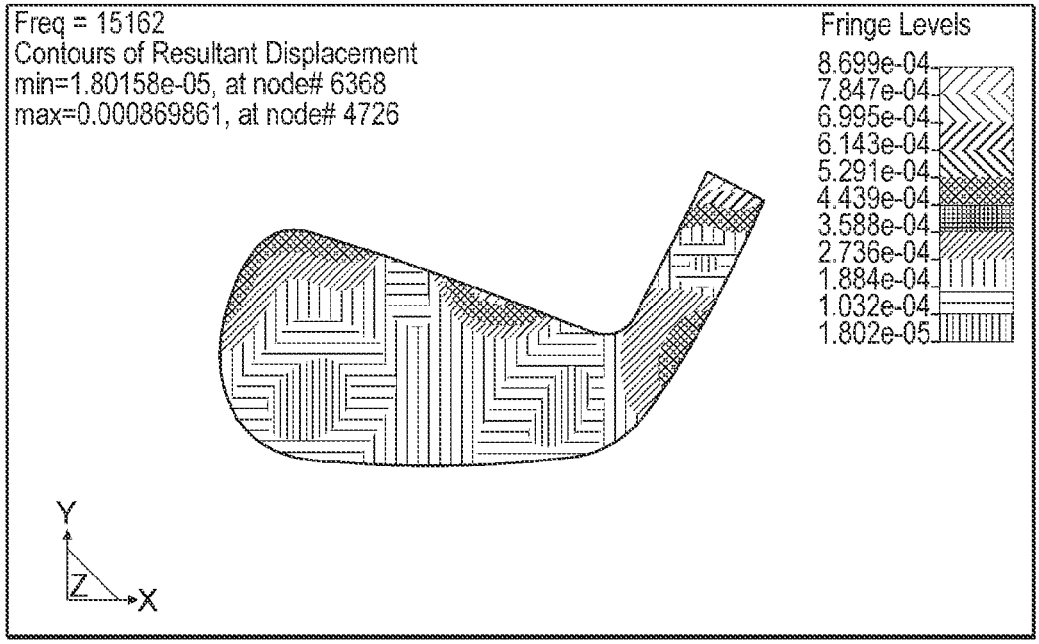
FIGS. 21A-21C illustrate seventh mode shapes for a conventional iron-type golf club and embodiments of the iron-type golf club according to the present invention.
Figure 21B:
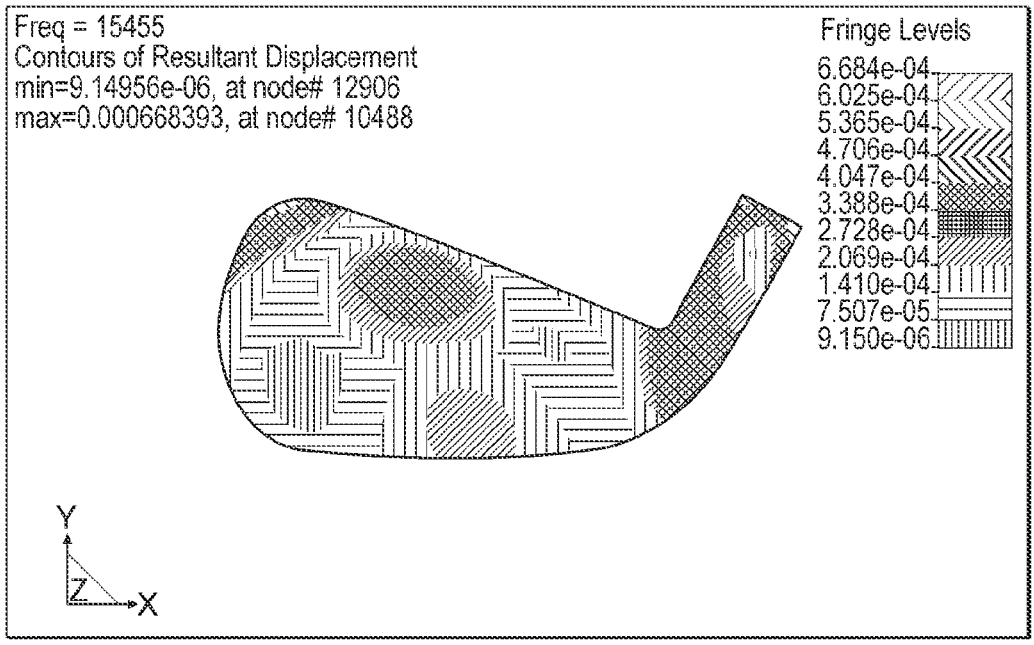
Figure 21C:
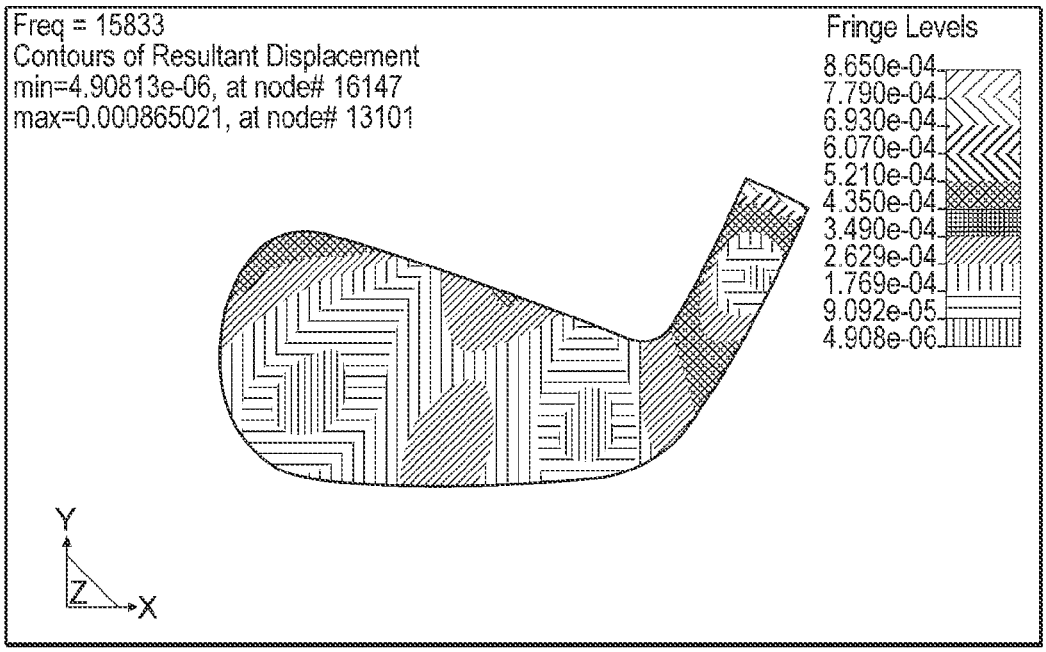

Referring to FIGS. 21A-21C, the seventh vibration mode shape of Embodiments A and B and the conventional iron-type golf club head are similar, however, the frequency values of that mode are greater for the embodiments of the present invention than the frequency value for the conventional iron-type golf club. Embodiment A exhibited a frequency value of 15455 Hz which is 2% greater than the frequency value of the conventional iron-type golf club, at 15162 Hz. Similarly, Embodiment B exhibited a frequency value of 15833 Hz, which is a 4% increase over that of the conventional iron-type golf club.

Figure 22A:
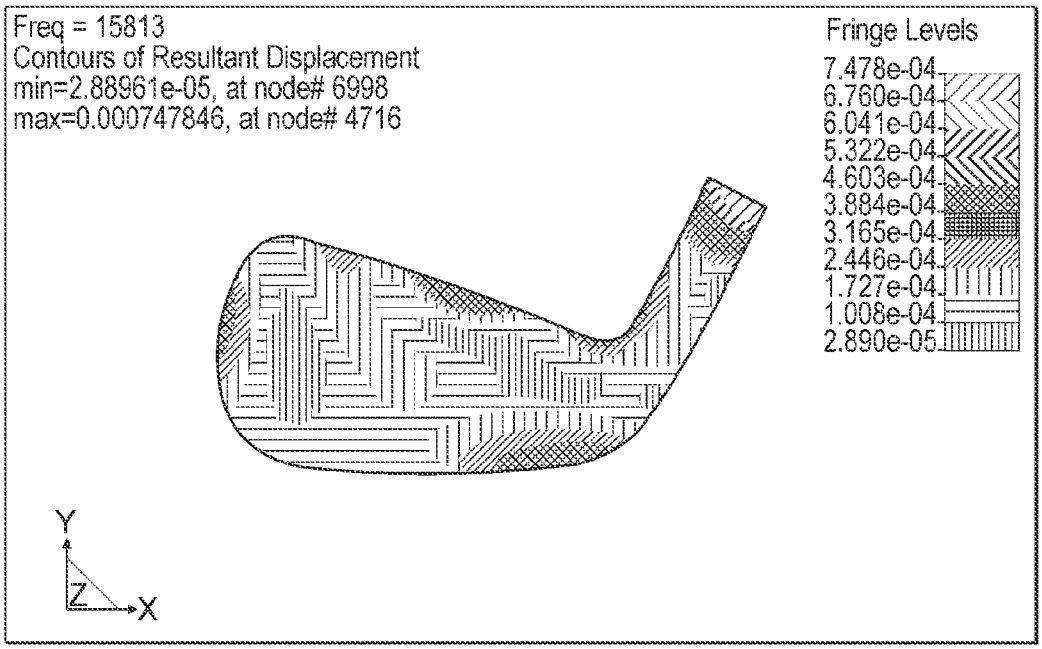
FIGS. 22A-22C illustrate eighth mode shapes for a conventional iron-type golf club and embodiments of the iron-type golf club according to the present invention.
Figure 22B:
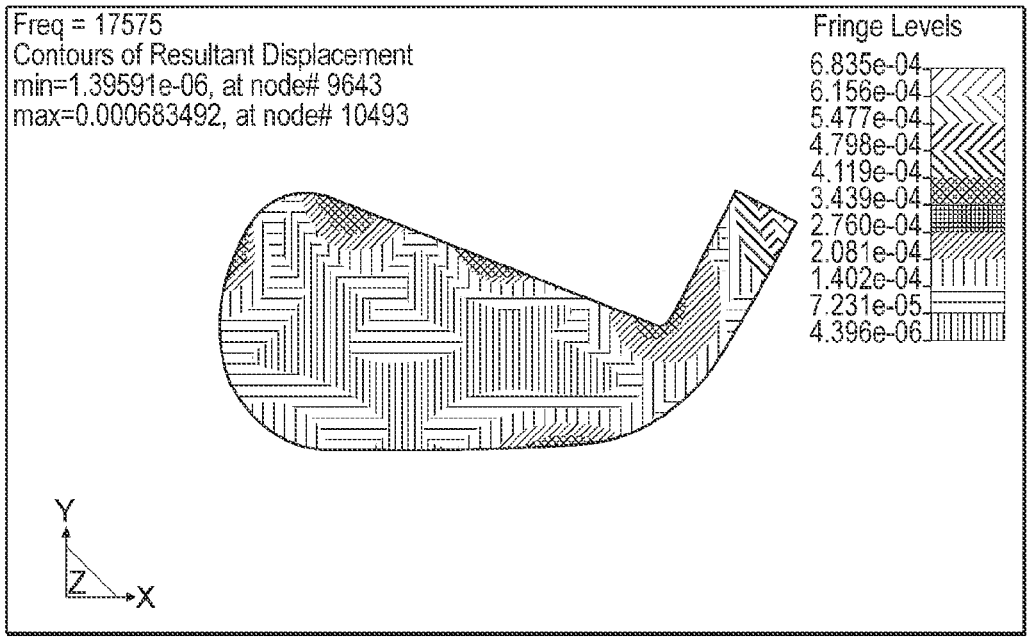
Figure 22C:
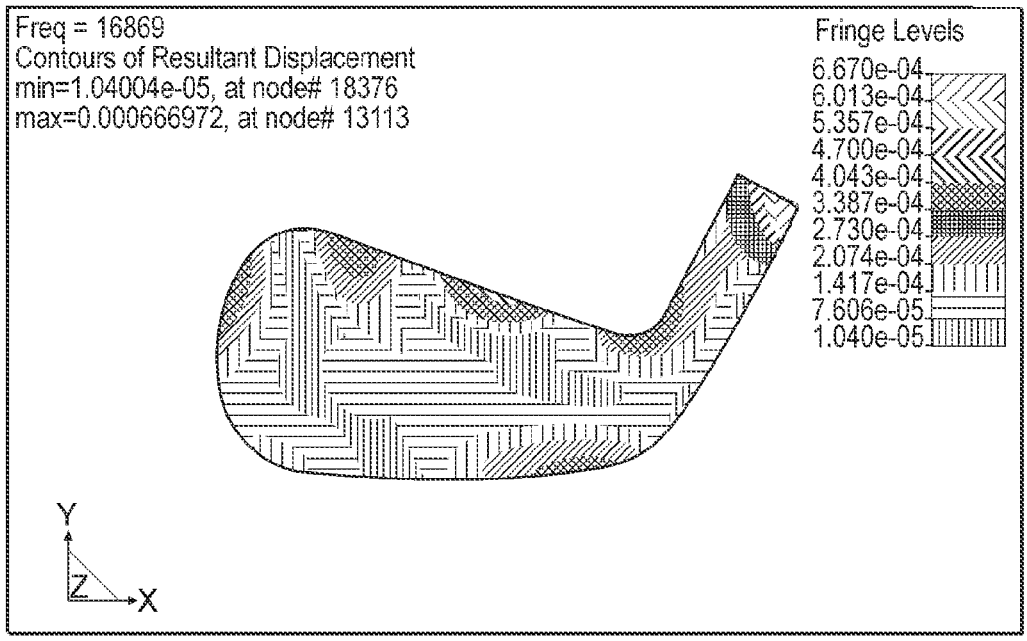

Referring to FIGS. 22A-22C, the eighth vibration mode shape of Embodiments A and B and the conventional iron-type golf club head are similar, however, the frequency values of that mode are greater for the embodiments of the present invention than the frequency value for the conventional iron-type golf club. Embodiment A exhibited a frequency value of 17575 Hz which is 11% greater than the frequency value of the conventional iron-type golf club, at 15813 Hz. Similarly, Embodiment B exhibited a frequency value of 16869 Hz, which is a 7% increase over that of the conventional iron-type golf club.

Figure 23A:
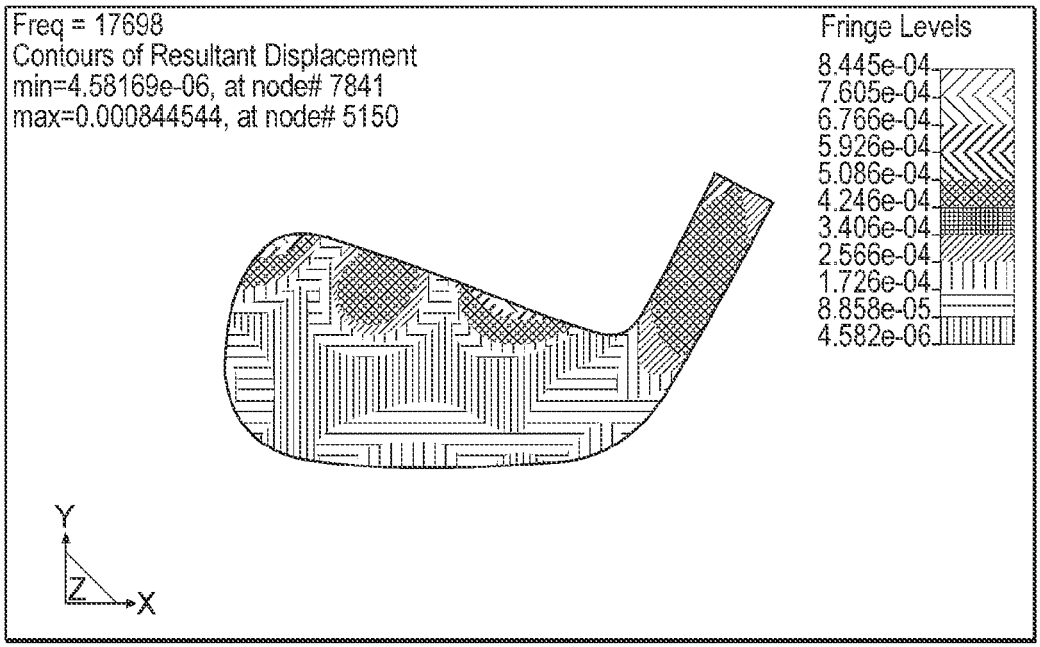
FIGS. 23A-23C illustrate ninth mode shapes for a conventional iron-type golf club and embodiments of the iron-type golf club according to the present invention.
Figure 23B:
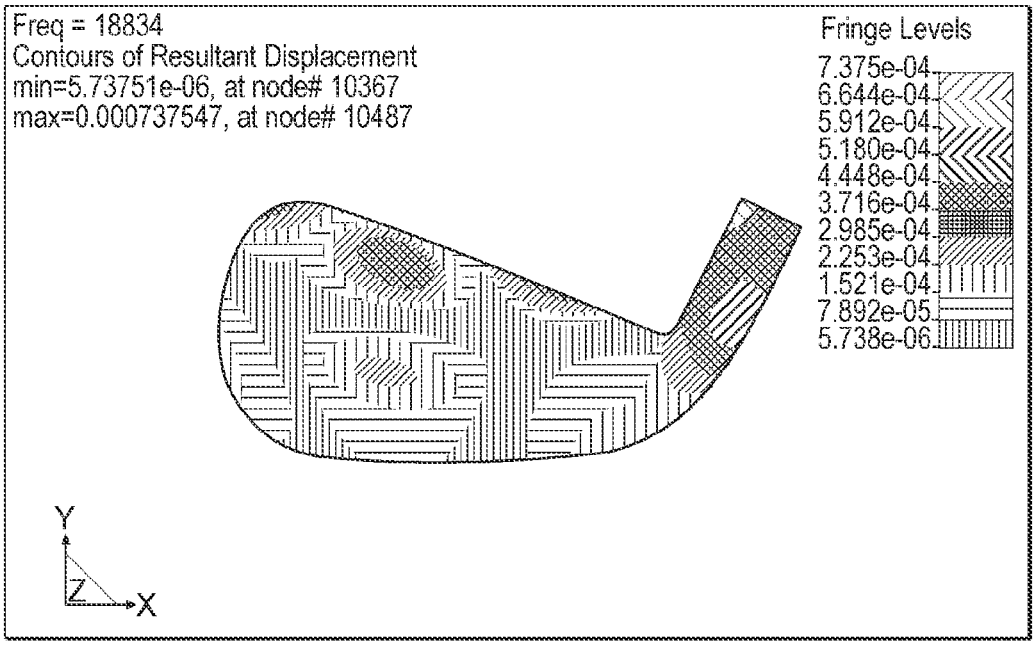
Figure 23C:
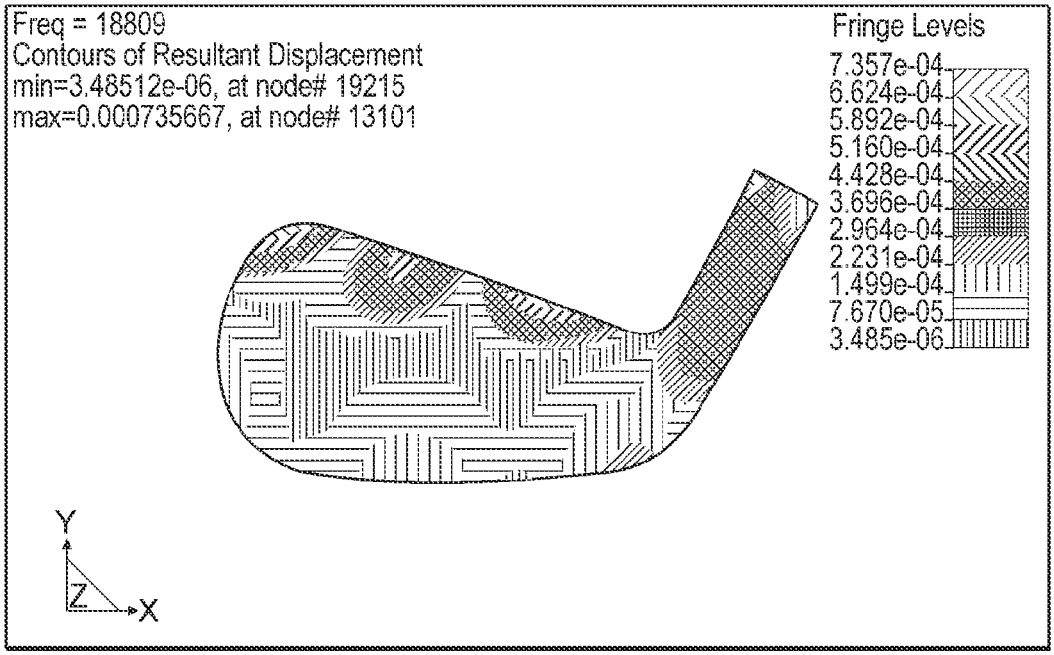

Referring to FIGS. 23A-23C, the ninth vibration mode shape of Embodiments A and B and the conventional iron-type golf club head are similar, however, the frequency values of that mode are greater for the embodiments of the present invention than the frequency value for the conventional iron-type golf club. Embodiment A exhibited a frequency value of 18834 Hz which is 6% greater than the frequency value of the conventional iron-type golf club, at 17698 Hz. Similarly, Embodiment B exhibited a frequency value of 18809 Hz, which is a 6% increase over that of the conventional iron-type golf club.

Figure 24A:
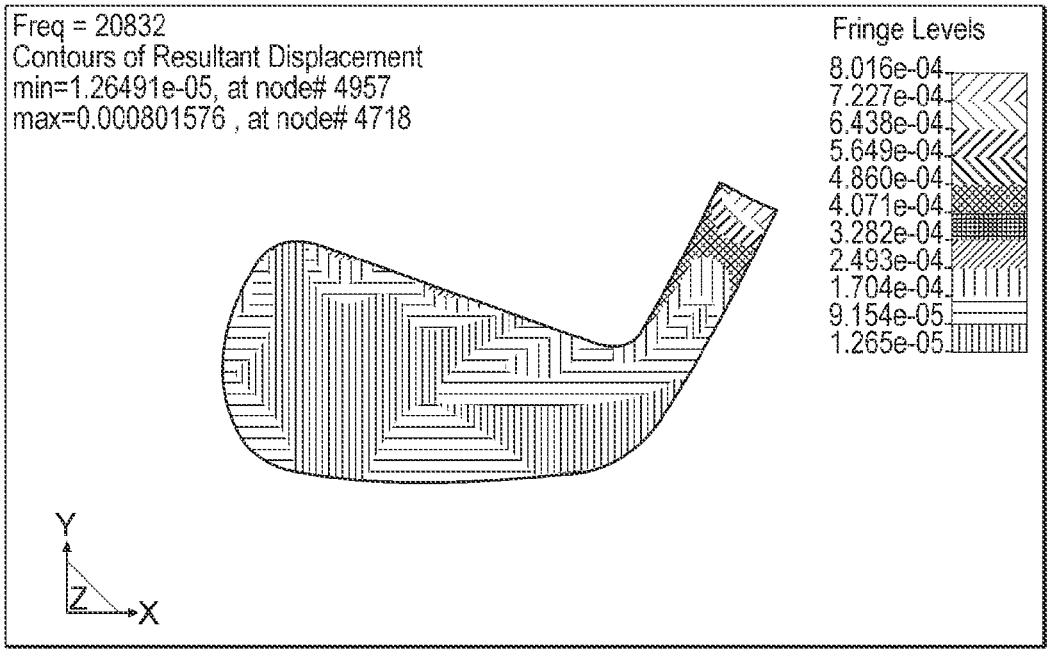
FIGS. 24A-24C illustrate tenth mode shapes for a conventional iron-type golf club and embodiments of the iron-type golf club according to the present invention.
Figure 24B:
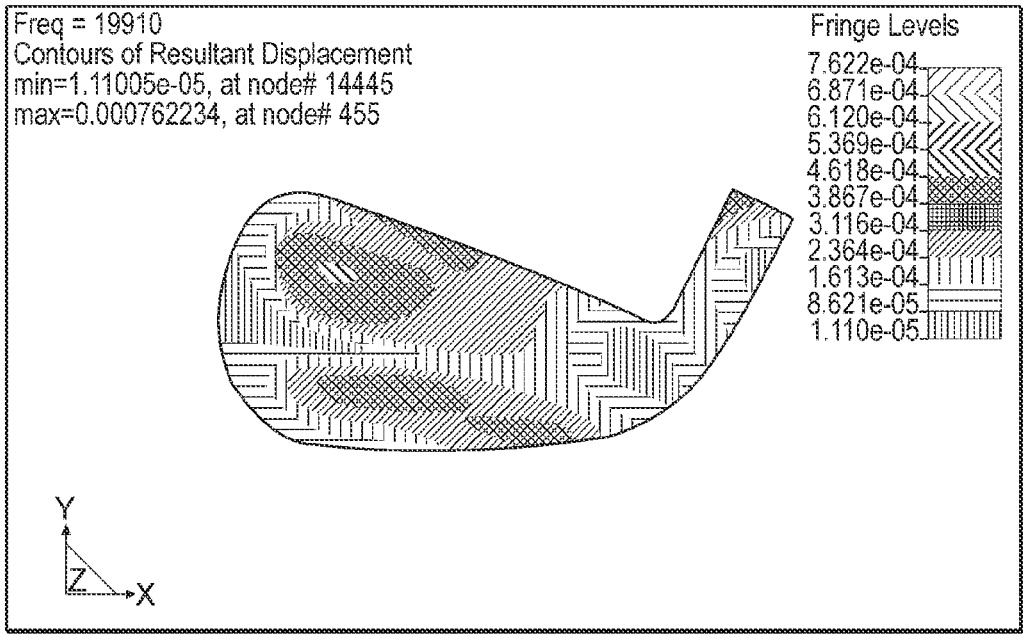
Figure 24C:
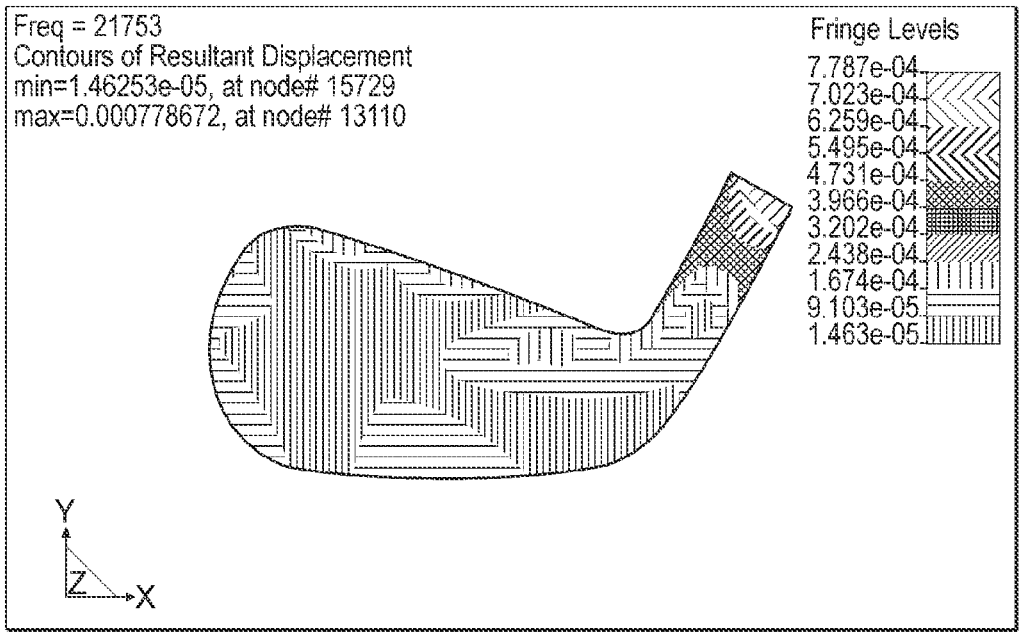

Finally, referring to FIGS. 24A-24C, the tenth vibration mode shape of Embodiment B and the conventional iron-type golf club are similar while the mode shape for Embodiment A differs. In particular, Embodiment B and the conventional golf club exhibit a mode shape in which a large portion of the face is encompassed by a region of minimum displacement. Embodiment A, on the other hand, exhibits a mode shape wherein small regions of minimum displacement are disposed at the heel and toe, but the majority of the face is encompassed by regions of maximum displacement. Additionally, the frequency value for that mode of Embodiment A is lower than that of the conventional iron, while the frequency value of Embodiment B is 21753 Hz, which is approximately 4% higher than that of the conventional iron, at 20832 Hz.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A golf club head, comprising:

a club head main body including a hosel and a top line;

a hitting face coupled to the club head main body;

a muscle back shell, that is a separate component from the main body, coupled to a rear portion of the club head main body; and a supporting member interposed between the club head main body and at least a portion of the muscle back shell and extending across a central portion of a rear surface of the hitting face in a generally heel to toe orientation, wherein the club head main body comprises a first material and the muscle back shell comprises a second material, wherein the muscle back shell forms a substantial portion of a sole surface of the golf club head, and wherein the club head has a first vibration mode frequency value of at least 4000 Hz.

2. The golf club head of claim 1, wherein the club head has a first vibration mode frequency value of at least 4400 Hz.

3. The golf club head of claim 1, wherein the club head has a second vibration mode frequency value of at least 5000 Hz.

4. The golf club head of claim 3, wherein the club head has a second vibration mode frequency value of at least 5500 Hz.

5. The golf club head of claim 1, wherein the club head has a third vibration mode frequency value of at least 7400 Hz.

6. The golf club head of claim 5, wherein the club head has a third vibration mode frequency value of at least 7700 Hz.

7. The golf club head of claim 1, wherein the first material has a density between about 4 g/cm$^3$ and about 8 g/cm$^3$ and the second material has a density between about 9 g/cm$^3$ and about 19 g/cm$^3$.

8. The golf club head of claim 1 further comprising a third material having a lower density than the first material, wherein the third material is coupled to the supporting member.

9. The golf club head of claim 8, wherein the third material is a viscoelastic material having a density in the range of about 0.8 g/cm$^3$ to about 1.5 g/cm$^3$ and about Shore A40 to Shore A90 hardness rating.

10. The golf club head of claim 1, wherein the hitting face is coupled to the club head main body by being integral with the club head main body as a monolithic body.

11. The golf club head of claim 1, wherein the supporting member is coupled to the club head main body by being integral with the club head main body as a monolithic body.

12. A golf club head comprising:

a club head main body including a hosel and a top line;

a hitting face;

a supporting member extending across a central portion of a rear surface of the hitting face in a generally heel to toe orientation; and a muscle back shell that is a separate component from the main body, wherein the hitting face is integral with the club head main body as a monolithic body, wherein the muscle back shell is coupled to the club head main body and the supporting member to define an enclosed cavity, wherein the muscle back shell forms a substantial portion of a sole surface of the golf club head, and wherein the club head has a first vibration mode frequency value of at least 4000 Hz.

13. The golf club head of claim 12, wherein the club head has a first vibration mode frequency value of at least 4400 Hz.

14. The golf club head of claim 12, wherein the club head has a second vibration mode frequency value of at least 5000 Hz.

15. The golf club head of claim 14, wherein the club head has a second vibration mode frequency value of at least 5500 Hz.

16. The golf club head of claim 12, wherein the club head has a third vibration mode frequency value of at least 7400 Hz.

17. The golf club head of claim 16, wherein the club head has a third vibration mode frequency value of at least 7700 Hz.

18. A golf club head comprising:

a club head main body including a hosel and a top line;

a hitting face coupled to the club head main body;

a supporting member extending across a central portion of a rear surface of the hitting face in a generally heel to toe orientation; and a muscle back shell that is a separate component from the main body, wherein muscle back shell is coupled to the club head main body and the supporting member to define an enclosed cavity, wherein the muscle back shell forms a substantial portion of a sole surface of the golf club head, and wherein the club head has a first vibration mode frequency value of at least 4000 Hz, a second vibration mode frequency value of at least 5000 Hz, and a third vibration mode frequency value of at least 7400 Hz.

19. The golf club head of claim 18, wherein the club head has a first vibration mode frequency value of at least 4400 Hz.

20. The golf club head of claim 19, wherein the club head has a second vibration mode frequency value of at least 5500 Hz.

* * * * *